US011377874B2

(12) United States Patent
Cheng

(10) Patent No.: US 11,377,874 B2
(45) Date of Patent: Jul. 5, 2022

(54) AUTO-LATCHING/LOCKING MORTISE LOCK FOR SLIDING DOOR

(71) Applicant: Qianyan Cheng, Sacramento, CA (US)

(72) Inventor: Qianyan Cheng, Sacramento, CA (US)

( * ) Notice: Subject to any disclaimer, the term of this patent is extended or adjusted under 35 U.S.C. 154(b) by 256 days.

(21) Appl. No.: 16/925,149

(22) Filed: Jul. 9, 2020

(65) Prior Publication Data

US 2021/0054663 A1 Feb. 25, 2021

Related U.S. Application Data

(60) Provisional application No. 62/889,710, filed on Aug. 21, 2019.

(51) Int. Cl.

| | |
|---|---|
| ***E05B 17/20*** | (2006.01) |
| ***E05B 65/08*** | (2006.01) |
| ***E05B 63/12*** | (2006.01) |
| ***E05B 63/08*** | (2006.01) |
| ***E05B 9/00*** | (2006.01) |
| ***E05B 9/02*** | (2006.01) |
| *E05B 47/00* | (2006.01) |

(Continued)

(52) U.S. Cl.

CPC ..... *E05B 17/2026* (2013.01); *E05B 9/002* (2013.01); *E05B 9/02* (2013.01); *E05B 17/2003* (2013.01); *E05B 17/2007* (2013.01); *E05B 17/2088* (2013.01); *E05B 63/08* (2013.01); *E05B 63/12* (2013.01); *E05B 63/127* (2013.01); *E05B 65/087* (2013.01); *E05B 15/04* (2013.01); *E05B 47/0002* (2013.01); *E05B 47/0012* (2013.01); *E05B 47/0607* (2013.01); *E05B 2047/0069* (2013.01); *E05Y 2900/132* (2013.01)

(58) Field of Classification Search

CPC ... E05B 9/00; E05B 9/002; E05B 9/02; E05B 15/04; E05B 17/20; E05B 17/2003; E05B 17/2026; E05B 17/2084; E05B 17/2088; E05B 47/0002; E05B 47/0012; E05B 47/0607; E05B 55/12; E05B 63/08; E05B 63/12; E05B 63/126; E05B 63/127; E05B 63/20; E05B 2063/207; E05B 65/08; E05B 65/0858; E05B 65/087

See application file for complete search history.

(56) References Cited

U.S. PATENT DOCUMENTS 2,668,073 A * 2/1954 Collar ..... E05B 63/127 292/192
3,175,376 A * 3/1965 Cantwell ..... E05B 17/042 70/145

(Continued)

*Primary Examiner* — Christopher J Boswell
(74) *Attorney, Agent, or Firm* — Craig A. Simmermon

(57) ABSTRACT

Auto latching mortise lock for sliding door is a mortise lock for a sliding door. Auto latching mortise lock for sliding door is a system with interchangeable components to yield multiple types of door locks including sliding door locks that meet the ANSI and BHMA standards for a passage, office, communicating/patio, storeroom, privacy, entry, and classroom lock for a sliding door. Auto latching mortise lock for sliding door mounts within a mortise pocket of a sliding door. Auto latching mortise lock for sliding door can automatically latch when the sliding door in closed and automatically unlatch when the sliding door is opened. Auto latching mortise lock for sliding door can also automatically lock when the sliding door in closed and automatically unlock when the sliding door is opened.

25 Claims, 29 Drawing Sheets

(51) Int. Cl.
*E05B 47/06* (2006.01)
*E05B 15/04* (2006.01)

(56) References Cited

U.S. PATENT DOCUMENTS 3,672,714 A * 6/1972 Schultz ..... E05B 59/00
292/336.5
4,566,725 A * 1/1986 Klein ..... E05B 63/127
292/191
5,820,177 A * 10/1998 Moon ..... E05B 63/20
292/335
7,188,870 B2 * 3/2007 Huang ..... E05B 63/16
70/462
7,497,486 B1 * 3/2009 Davis ..... E05B 63/16
292/169.14
7,836,737 B2 * 11/2010 Lin ..... E05B 63/127
292/159
8,292,336 B2 * 10/2012 Moon ..... E05B 63/04
70/462
8,641,104 B1 * 2/2014 Tien ..... E05B 63/16
292/244
9,803,395 B2 * 10/2017 Chen ..... E05B 63/08
10,422,164 B2 * 9/2019 Cheng ..... E05B 65/0858

* cited by examiner

AUTO-LATCHING/LOCKING MORTISE LOCK FOR SLIDING DOOR

CROSS-REFERENCE TO RELATED APPLICATIONS

The instant application claims the benefit of Provisional Application Ser. No. 62/889,710 entitled "SLIDING/POCKET DOOR LOCK WITH ADVANCED FEATURES" filed on Aug. 21, 2019, which is hereby incorporated by reference herein.

BACKGROUND OF THE INVENTION

1. Field of the Invention

This invention relates to a mortise lock or a mortise lockset for a sliding door. A mortise lockset is a lockset for a door that requires a pocket or a mortise to be cut into the edge of the door wherein a mortise lock is installed. A mortise lock set may be installed into a hinged door or a sliding door. Specifically, this invention relates to a mortise lock that is installed into a sliding door. The mortise lock of this invention is special because it has an automatic latching and unlatching mechanism along with an automatic locking and unlocking mechanism.

2. Description of Related Art

There are many mortise locksets in the prior art however there are none for a sliding door with the automatic latching, automatic unlatching, automatic locking, and automatic unlocking mechanisms as shown and described below.

Auto-latching/locking mortise lock for sliding door is a system with interchangeable components to yield multiple types of door locks. Auto-latching/locking mortise lock for sliding door is the first mortise lock system for a sliding door that meets the ANSI and BHMA standards for a passage, office, communicating/patio, storeroom, privacy, entry, and classroom door lock.

BRIEF SUMMARY OF THE INVENTION

Auto-latching/locking mortise lock for sliding door is a sliding door lock mechanism that is fully contained within a rectangular cuboid shaped casing or housing.

Auto-latching/locking mortise lock for sliding door is a system with interchangeable components to yield multiple types of door locks.

Auto-latching/locking mortise lock for sliding door can be configured to meet the ANSI and BHMA standards for a passage, office, communicating/patio, storeroom, privacy, entry, and classroom lock for a sliding door.

Auto-latching/locking mortise lock for sliding door mounts within a mortise pocket of a sliding door and engages with an inside door knob or lever on the inside of a room and engages with an outside door knob or lever on the outside of a room.

It is an aspect of auto-latching/locking mortise lock for sliding door to have a mechanism that automatically latches the sliding door when the sliding door is closed.

It is an aspect of auto-latching/locking mortise lock for sliding door to have a mechanism that automatically unlatches the sliding door when the inside door knob or door lever is turned.

It is an aspect of auto-latching/locking mortise lock for sliding door to have a mechanism that automatically unlatches the sliding door when the outside door knob or door lever is turned, with certain embodiments.

It is an aspect of auto-latching/locking mortise lock for sliding door to have a mechanism that keeps the sliding door latched when the outside door knob or door lever is turned, with certain embodiments.

It is an aspect of auto-latching/locking mortise lock for sliding door to have a mechanism that automatically locks the sliding door when the sliding door is closed.

It is an aspect of auto-latching/locking mortise lock for sliding door to have a mechanism that automatically unlocks the sliding door when the inside door knob or door lever is turned.

It is an aspect of auto-latching/locking mortise lock for sliding door to have a mechanism that automatically unlocks the sliding door when the outside door knob or door lever is turned, with certain embodiments.

It is an aspect of auto-latching/locking mortise lock for sliding door to have a mechanism that keeps the sliding door locked when the outside door knob or door lever is turned, with certain embodiments.

It is an aspect of auto-latching/locking mortise lock for sliding door to have a deadbolt that extends to latch and/or lock the sliding door and retracts to unlatch and/or unlock the sliding door.

It is an aspect of auto-latching/locking mortise lock for sliding door to have a deadbolt with an upper deadbolt wing and a lower deadbolt wing wherein both extend or protrude from deadbolt to latch and/or lock the sliding door and both retract into deadbolt to unlatch and/or unlock the sliding door.

It is an aspect of auto-latching/locking mortise lock for sliding door to have a bolt release actuator with a button that triggers the deadbolt from auto-latching/locking mortise lock for sliding door to extend to latch and/or lock the sliding door.

It is an aspect of auto-latching/locking mortise lock for sliding door to have a bolt release actuator with a button that triggers the upper and lower deadbolt wings to extend from deadbolt to latch and/or lock the sliding door.

It is an aspect of auto-latching/locking mortise lock for sliding door to retract the deadbolt to unlatch and/or unlock the sliding door when the door knob or door lever is rotated, under certain conditions.

It is an aspect of auto-latching/locking mortise lock for sliding door to retract the upper and lower deadbolt wings to unlatch and/or unlock the sliding door when the door knob or door lever is rotated, under certain conditions.

It is an aspect of auto-latching/locking mortise lock for sliding door to have a lock block that engages with inside and/or outside lever hub or knob hub to automatically lock and unlock the sliding door, with certain embodiments.

It is an aspect of auto-latching/locking mortise lock for sliding door to have a lock block that does not engages with inside and/or outside lever hub or knob hub to keep the sliding door locked, with certain embodiments.

DEFINITION LIST

Figure 1:
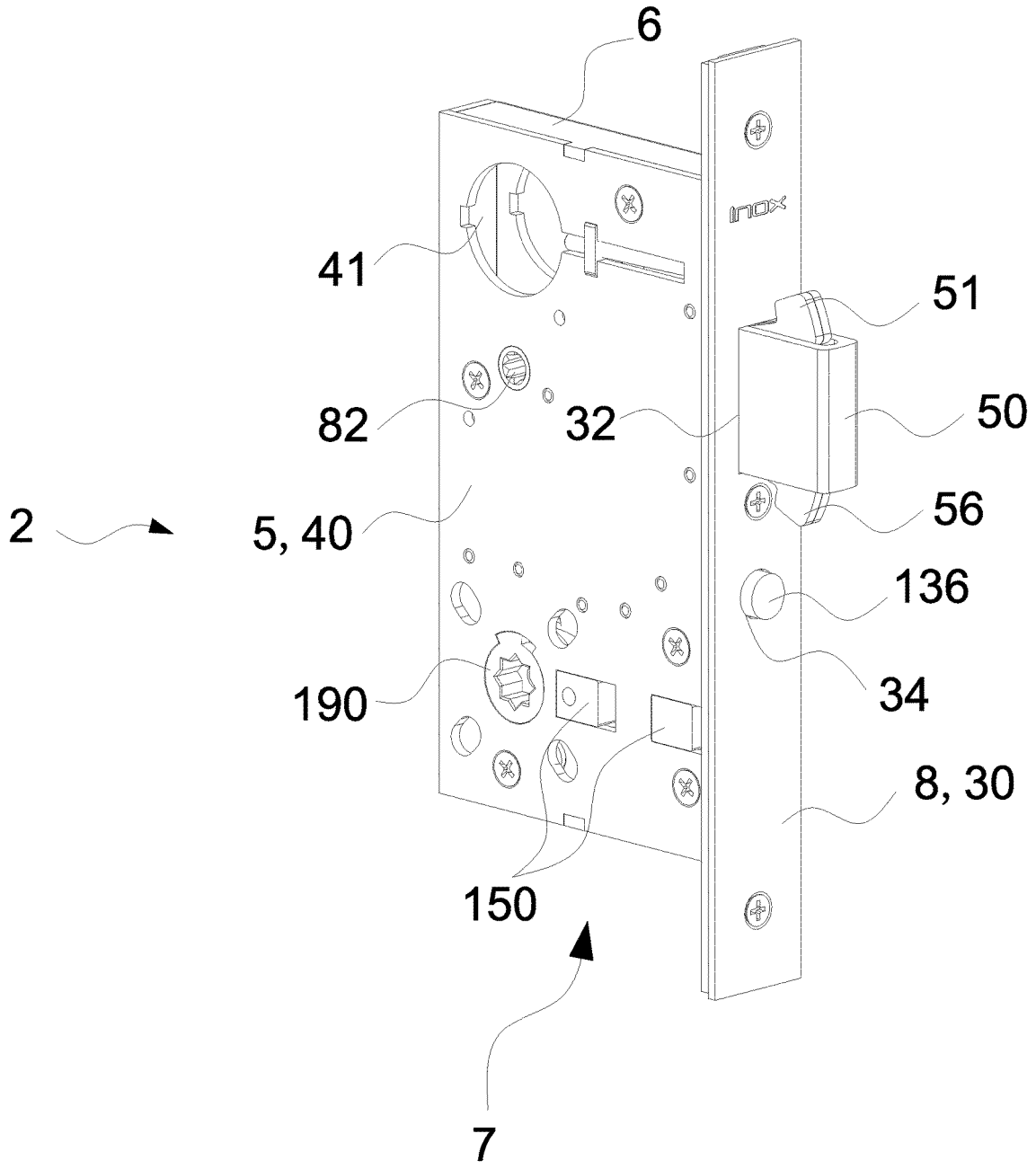
FIG. 1 is a front perspective view of auto-latching/locking mortise lock for sliding door.

| Term | Definition |
|---|---|
| 2 | Auto-Latching/Locking Mortise Lock for Sliding Door |
| 4 | First Side of Mortise Lock |
| 5 | Second Side of Mortise Lock |

-continued

| Term | Definition |
|---|---|
| 6 | Upper Side of Mortise Lock |
| 7 | Lower Side of Mortise Lock |
| 8 | Opening Side of Mortise Lock |
| 9 | Retracting Side of Mortise Lock |
| 10 | Mortise Housing Base |
| 11 | Lock Cylinder Mounting Hole |
| 12 | Upper Deadbolt Mounting Pin |
| 13 | Lower Deadbolt Mounting Pin |
| 14 | T-Turn Hub Mounting Hole on Mortise Housing Base |
| 15 | T-Turn Hub Stop Pin |
| 16 | T-Turn Hub Support Pillar |
| 17 | Deadbolt Shaft Slot Track |
| 18 | Trigger Lever and Bolt Retraction Lever Pivot Pin |
| 19 | Trigger Lever Spring Pivot Pin |
| 20 | Lock Block Lever Pivot Pin |
| 21 | Bolt Release Actuator Slot Track Pin |
| 22 | Bolt Release Actuator Mounting Pin |
| 23 | Lever Hub Mounting Hole on Mortise Housing Base |
| 24 | Key Notch on Lever Hub Mounting Hole |
| 25 | Retracting Side Lock Block Slot Track on Mortise Housing Base |
| 26 | Opening Side Lock Block Slot Track on Mortise Housing Base |
| 27 | Lever Hub Spring Pivot Support Pillar |
| 28 | Lock Block Spring Pivot Support Pillar |
| 29 | Other Support Pillar |
| 30 | Mortise Housing Face Plate |
| 32 | Deadbolt Clearance Hole in Mortise Housing Face Plate |
| 34 | Button Clearance Hole in Mortise Housing Face Plate |
| 36 | Upper Tab Flange |
| 38 | Lower Tab Flange |
| 39 | Female Threaded or Tapped Hole |
| 40 | Mortise Housing Cover Plate |
| 41 | Lock Cylinder Mounting Hole in Mortise Housing Cover Plate |
| 42 | T-Turn Hub Mounting Hole in Mortise Housing Cover Plate |
| 43 | Lever Hub Mounting Hole in Mortise Housing Cover Plate |
| 44 | Key Notch on Lever Hub Mounting Hole |
| 45 | Retracting Side Lock Block Slot Track in Mortise Housing Cover Plate |
| 46 | Opening Side Lock Block Slot Track in Mortise Housing Cover Plate |
| 47 | Pin Mounting Hole in Mortise Housing Cover Plate |
| 48 | Screw Hole in Mortise Housing Cover Plate |
| 49 | Mortise Housing Screw |
| 50 | Deadbolt |
| 51 | Upper Deadbolt Wing |
| 52 | Upper Deadbolt Wing Pivot Pin |
| 53 | Upper Deadbolt Wing Latch Protrusion |
| 54 | Upper Deadbolt Wing Heel Protrusion |
| 55 | Deadbolt Wing Spring |
| 56 | Lower Deadbolt Wing |
| 57 | Lower Deadbolt Wing Pivot Pin |
| 58 | Lower Deadbolt Wing Latch Protrusion |
| 59 | Lower Deadbolt Wing Heel Protrusion |
| 60 | Deadbolt Shaft |
| 62 | Deadbolt Attachment Arm on Deadbolt Shaft |
| 63 | Deadbolt Attachment Pin on Deadbolt Shaft |
| 64 | Pendulum Arm Pocket in Deadbolt Shaft |
| 66 | Tab on Deadbolt Shaft |
| 68 | Trigger Lever Notch on Deadbolt Shaft |
| 70 | Deadbolt Spring |
| 80 | T-Turn Hub |
| 82 | Socket on T-Turn Hub |
| 84 | First Lock Cylinder Catch Arm |
| 86 | Second Lock Cylinder Catch Arm |
| 88 | Fork Arm on T-Turn Hub |
| 90 | Bolt Retraction Hub |
| 92 | Socket on Bolt Retraction Hub |
| 94 | Pendulum Arm |
| 96 | Head on Pendulum Arm |
| 100 | Bolt Retraction Lever |
| 102 | Pivot Hole on Bolt Retraction Lever |
| 104 | Upper Arm on Bolt Retraction Lever |
| 106 | Lower Arm on Bolt Retraction Lever |
| 108 | Pin on Lower Arm of Bolt Retraction Lever |
| 110 | Trigger Lever |
| 111 | Pivot Hole on Trigger Lever |
| 112 | First Arm on Trigger Lever |
| 113 | Pin on First Arm of Trigger Lever |

-continued

| Term | Definition |
|---|---|
| 114 | Second Arm on Trigger Lever |
| 115 | Catch Tab on Second Arm of Trigger Lever |
| 120 | Trigger Lever Spring |
| 130 | Bolt Release Actuator |
| 132 | Cam Surface on Bolt Release Actuator |
| 134 | Slot Track on Bolt Release Actuator |
| 136 | Button on Bolt Release Actuator |
| 140 | Lock Block Lever |
| 142 | Pivot Hole on Lock Block Lever |
| 144 | Upper Arm on Lock Block Lever |
| 146 | Lower Arm on Lock Block Lever |
| 150 | Lock Block |
| 151 | First Tab on Lock Block |
| 152 | Pin Hole on First Tab |
| 153 | Screw Hole on First Tab |
| 154 | Second Tab on Lock Block |
| 155 | Pin Hole on Second Tab |
| 156 | Screw Hole on Second Tab |
| 157 | Lock Block Lever Pocket |
| 158 | First Heel on Lock Block |
| 159 | Second Heel on Lock Block |
| 160 | Spring Ridge |
| 161 | Lock Block Pin |
| 162 | Lock Block Screw |
| 170 | Lock Block Spring |
| 180 | First Lever Hub |
| 182 | Socket on First Lever Hub |
| 183 | Key Tab on First Lever Hub |
| 184 | Bolt Retraction Arm on First Lever Hub |
| 186 | Lock Block Arm on First Lever Hub |
| 187 | V-shaped notch on First Lever Hub |
| 188 | U-shaped notch on First Lever Hub |
| 190 | Second Lever Hub |
| 192 | Socket on Second Lever Hub |
| 193 | Key Tab on Second Lever Hub |
| 194 | Bolt Retraction Arm on Second Lever Hub |
| 196 | Lock Block Arm on Second Lever Hub |
| 197 | V-shaped notch on Second Lever Hub |
| 198 | U-shaped notch on Second Lever Hub |
| 200 | Lever Hub Spring |

DETAILED DESCRIPTION OF THE INVENTION

Auto-latching/locking mortise lock for sliding door 2 is a component of or a portion of a mortise lockset. A mortise lockset is a lockset for a door that requires a pocket or mortise to be cut into the edge of the door wherein a mortise lock is installed. A mortise lock set may be installed in a hinged door or a sliding door. A mortise lockset comprises: a mortise lock; a face plate (not depicted); a spindle (not depicted); two knobs (not depicted) or two levers (not depicted); and a strike plate (not depicted). All components of a mortise lockset are usually sold together as a set or kit. The mortise lock, spindle, two knobs or two levers, and face plate are installed into the door (not depicted). The strike plate is installed in the door jamb (not depicted) or wall (not depicted).

Auto-latching/locking mortise lock for sliding door 2 is a mortise lock that is installed into a sliding door (not depicted). Auto-latching/locking mortise lock for sliding door 2 is a complicated series of mechanical actions encased within a rigid rectangular cuboid shaped case or housing that is installed within the pocket or mortise of a sliding door. A sliding door is any type of door that slides left or right to open and close rather than pivot or rotate to open or close. A sliding door could be a barn door, patio door, French door, pocket door, or any other type of sliding door.

Auto-latching/locking mortise lock for sliding door 2 is special because it allows the sliding door to automatically latch with a deadbolt 50 when the sliding door is closed and automatically unlatch or retract deadbolt 50, when a door knob or door lever is turned, under certain conditions, as described below. Additionally, auto-latching/locking mortise lock for sliding door 2 is special because it allows the sliding door to automatically lock the deadbolt 50 when the sliding door is closed, under certain conditions, as described below, and automatically unlock the deadbolt 50, when a door knob or door lever is turned, under certain conditions, as described below. Hence, auto-latching/locking mortise lock for sliding door 2 has automatic latching and automatic unlatching mechanisms along with automatic locking and automatic unlocking mechanisms.

A sliding door has a width, a length, and a thickness. A sliding door has a vertical axis running parallel to its length dimension and a horizontal axis running parallel to its width dimension. A sliding door has an inward side, an outward side, an upper side, a lower side, an opening side, and a retracting side. The inward side of the sliding door is the large vertical side or panel side of the sliding door that is adjacent to the interior of the room. The outward side of the sliding door is the large vertical side or panel side of the sliding door that is adjacent to the exterior of the room. The upper side of the sliding door is the horizontal side or edge of the door that is most proximate to the ceiling of the room. The lower side of the sliding door is the horizontal side or edge of the door that is most proximate to the floor of the building. The opening side of the sliding door is the vertical side or edge of the door that parts or slides open to allow passage through the doorway and slides closed to disallow passage through the doorway. The retracting side of the sliding door is the vertical side or edge of the door that is opposite from the opening side of the sliding door. A sliding door may be installed so that it slides open in the left direction or slides open to in right direction.

Figure 2:
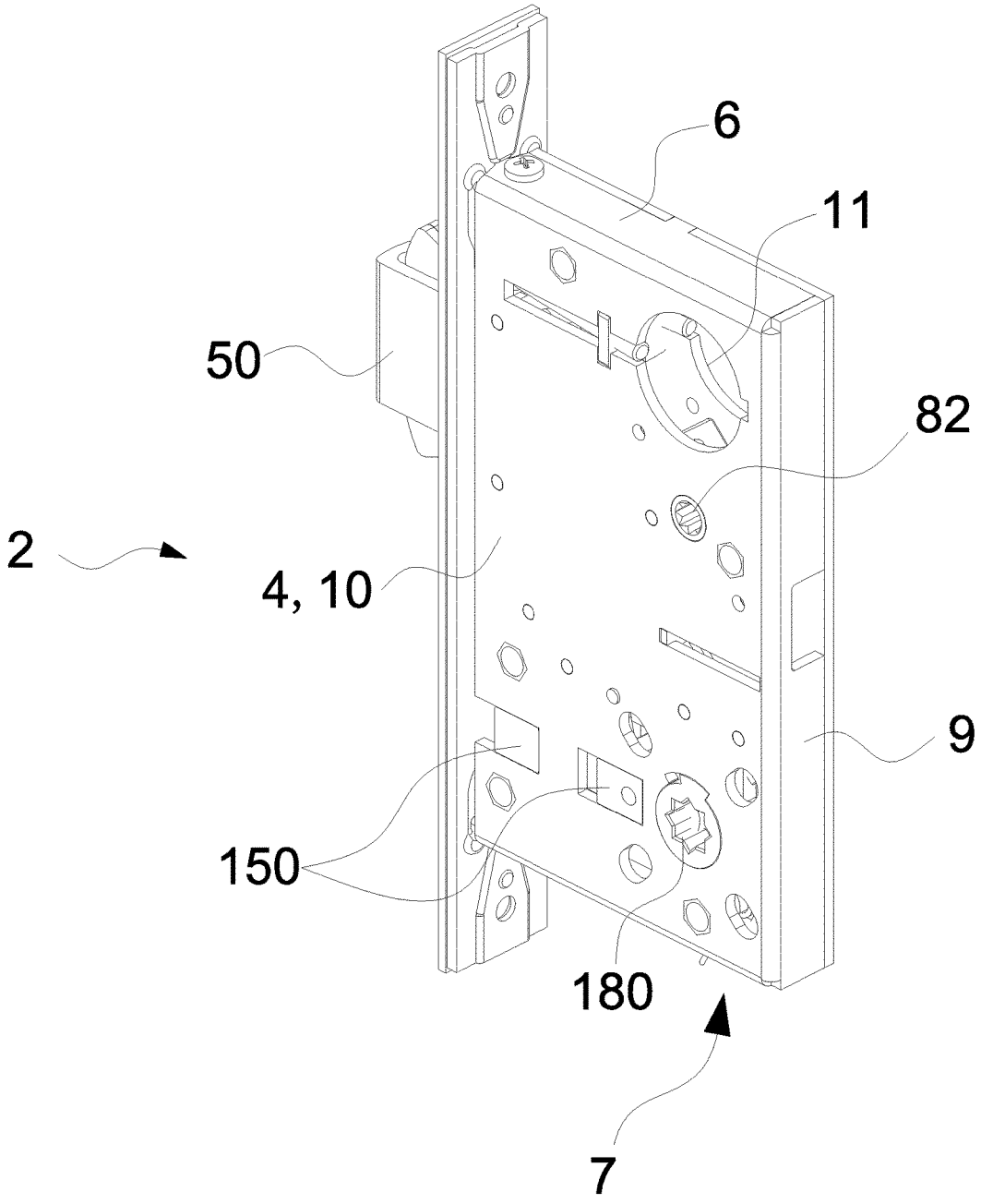
FIG. 2 is a rear perspective view of auto-latching/locking mortise lock for sliding door.
Figure 3:
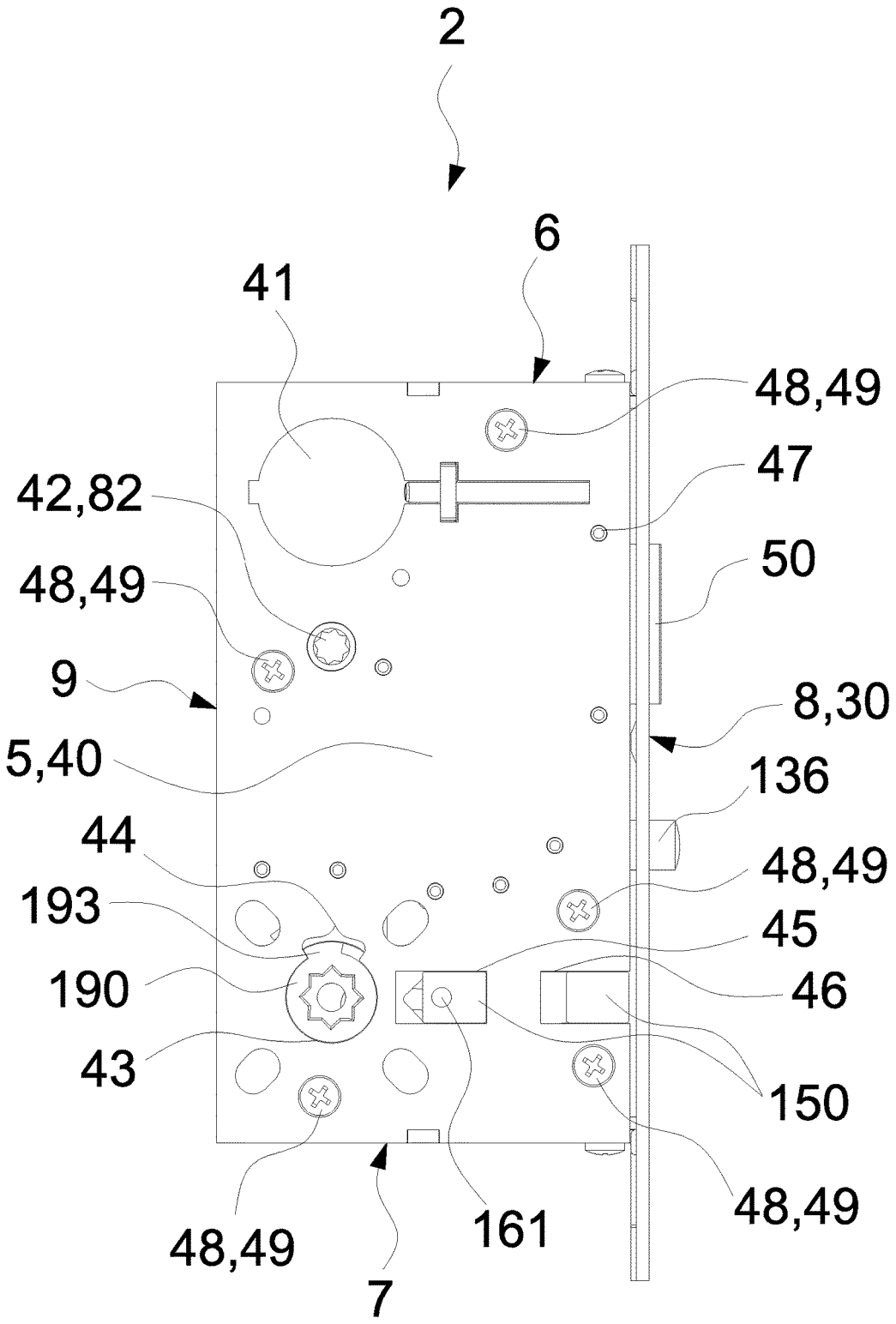
FIG. 3 is a side elevation view of the second side of an embodiment of auto-latching/locking mortise lock for sliding door with lock block pins.
Figure 4:
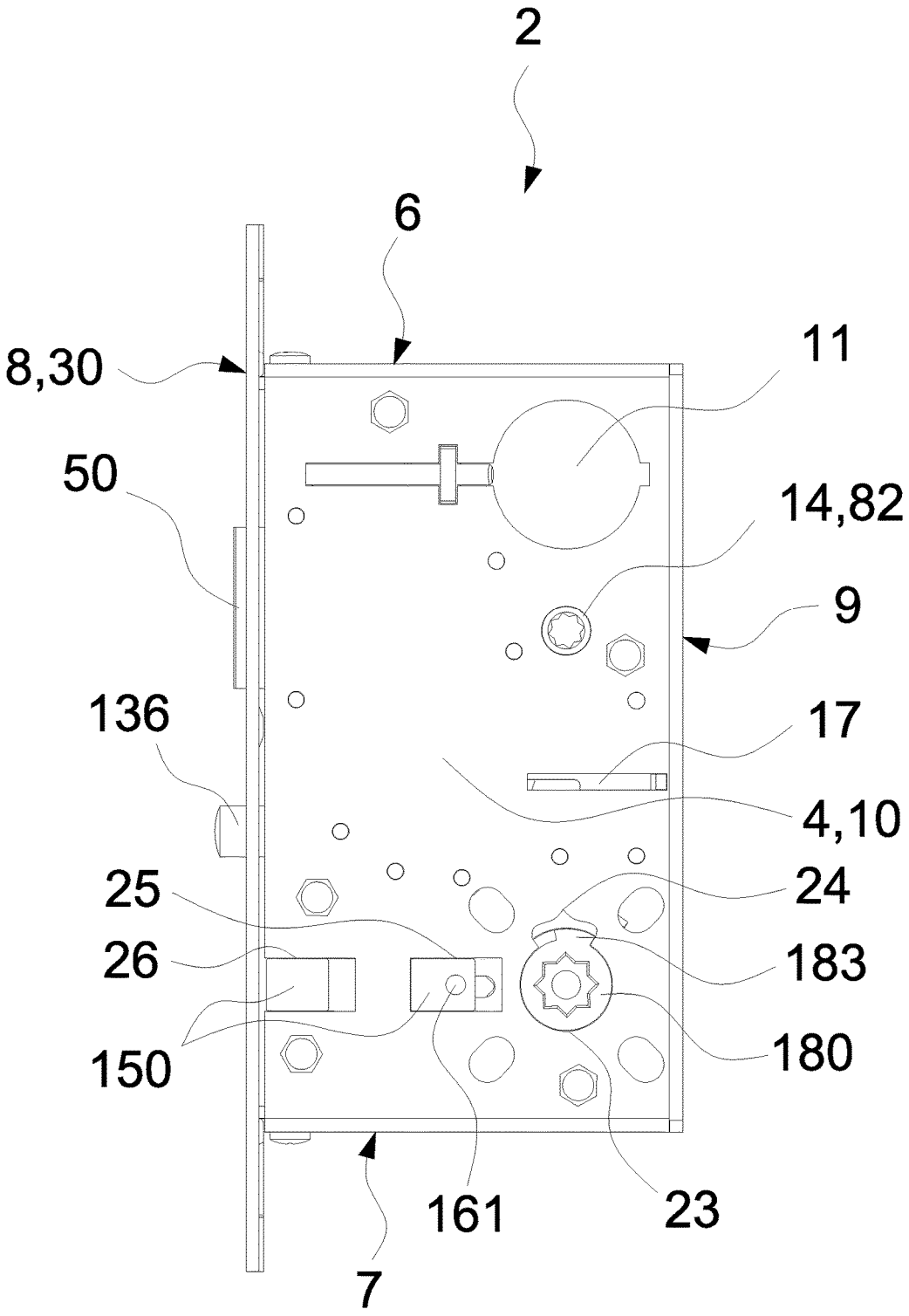
FIG. 4 is a side elevation view of the first side of an embodiment of auto-latching/locking mortise lock for sliding door with lock block pins.
Figure 5:
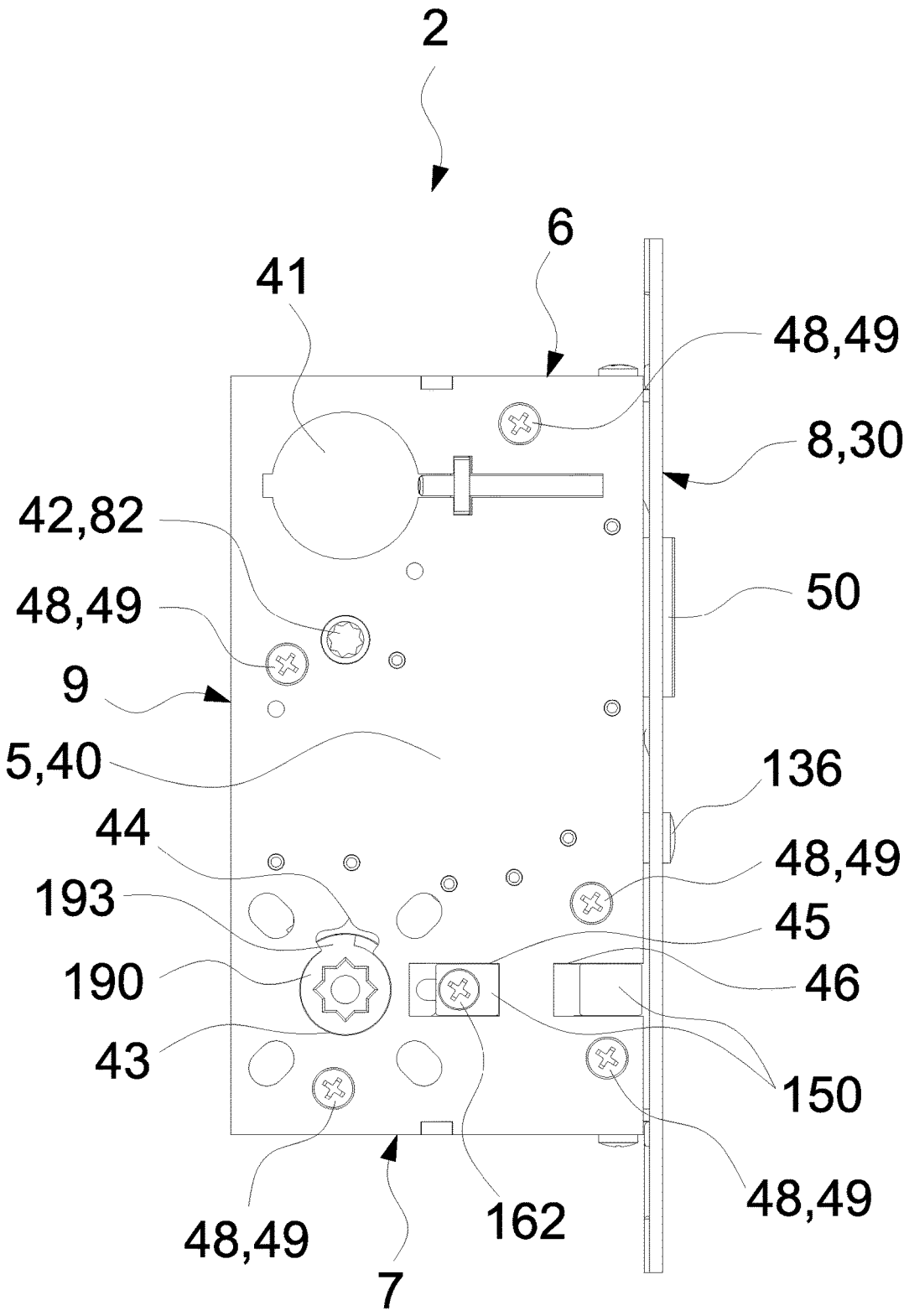
FIG. 5 is a side elevation view of the second side of an embodiment of auto-latching/locking mortise lock for sliding door with lock block screws.
Figure 6:
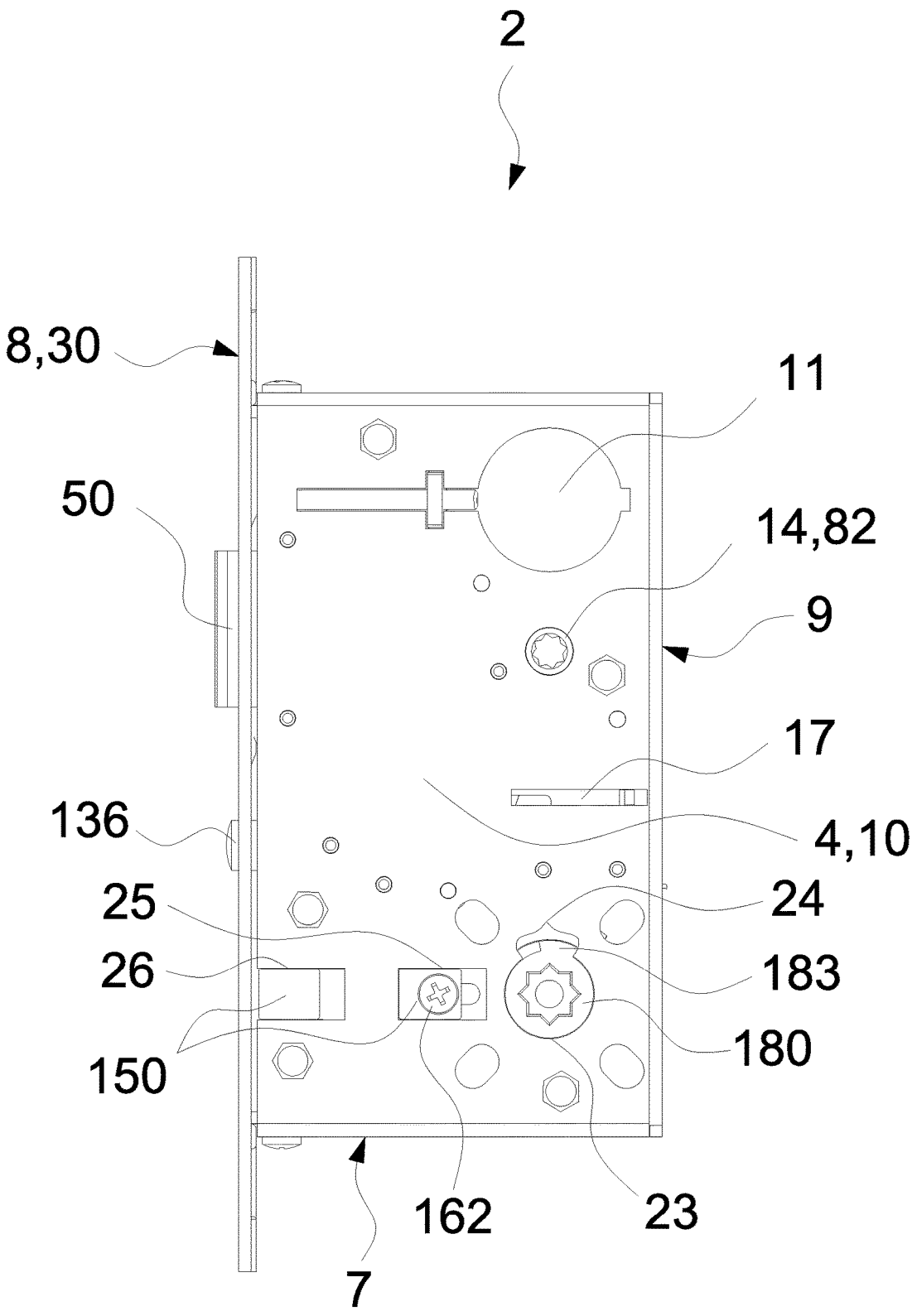
FIG. 6 is a side elevation view of the first side of an embodiment of auto-latching/locking mortise lock for sliding door with lock block screws.
Figure 7:
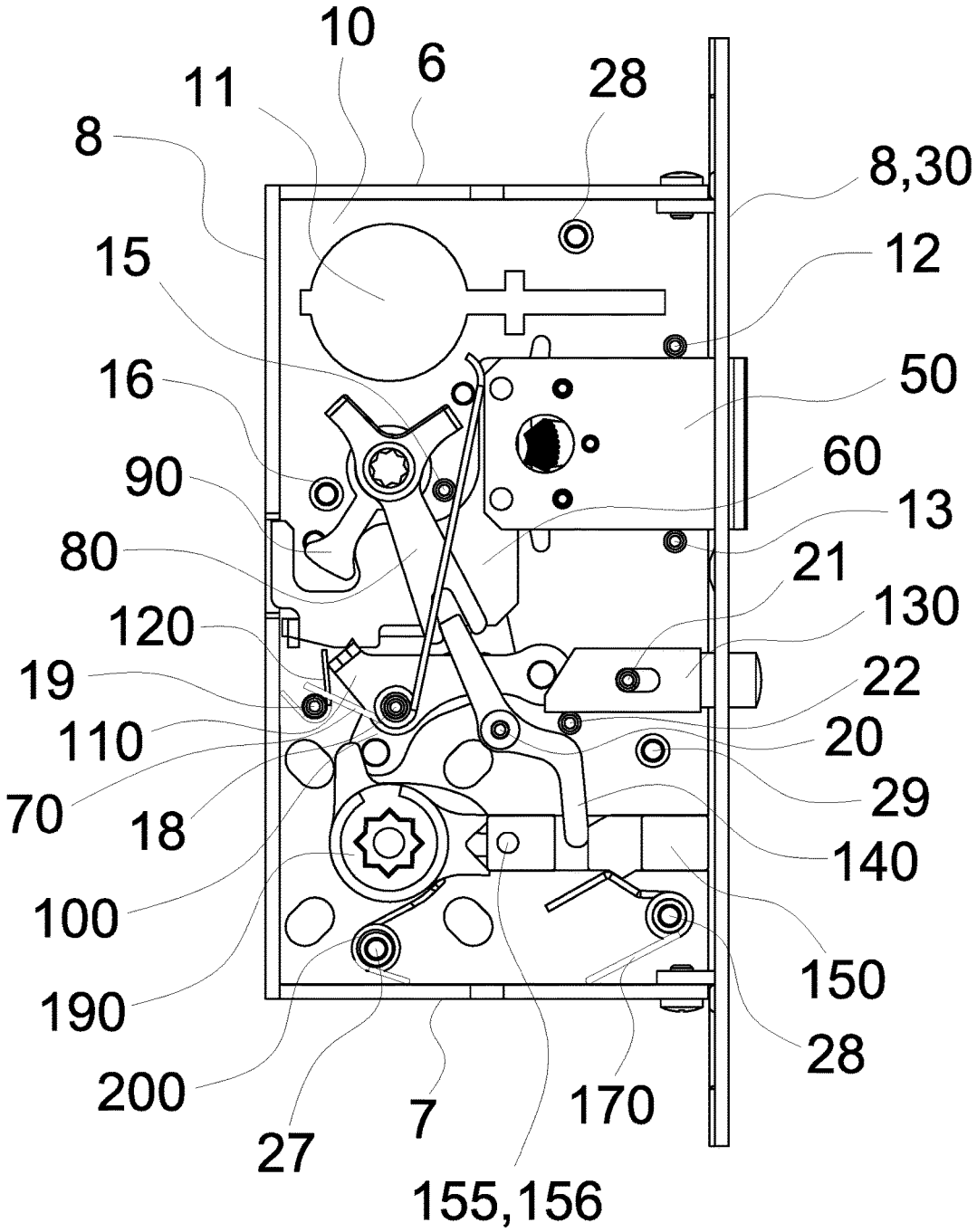
FIG. 7 is a side elevation view of the second side of auto-latching/locking mortise lock for sliding door with the mortise housing cover plate removed, the deadbolt in the retracted position, and the lock block in the unlocked position.
Figure 7A:
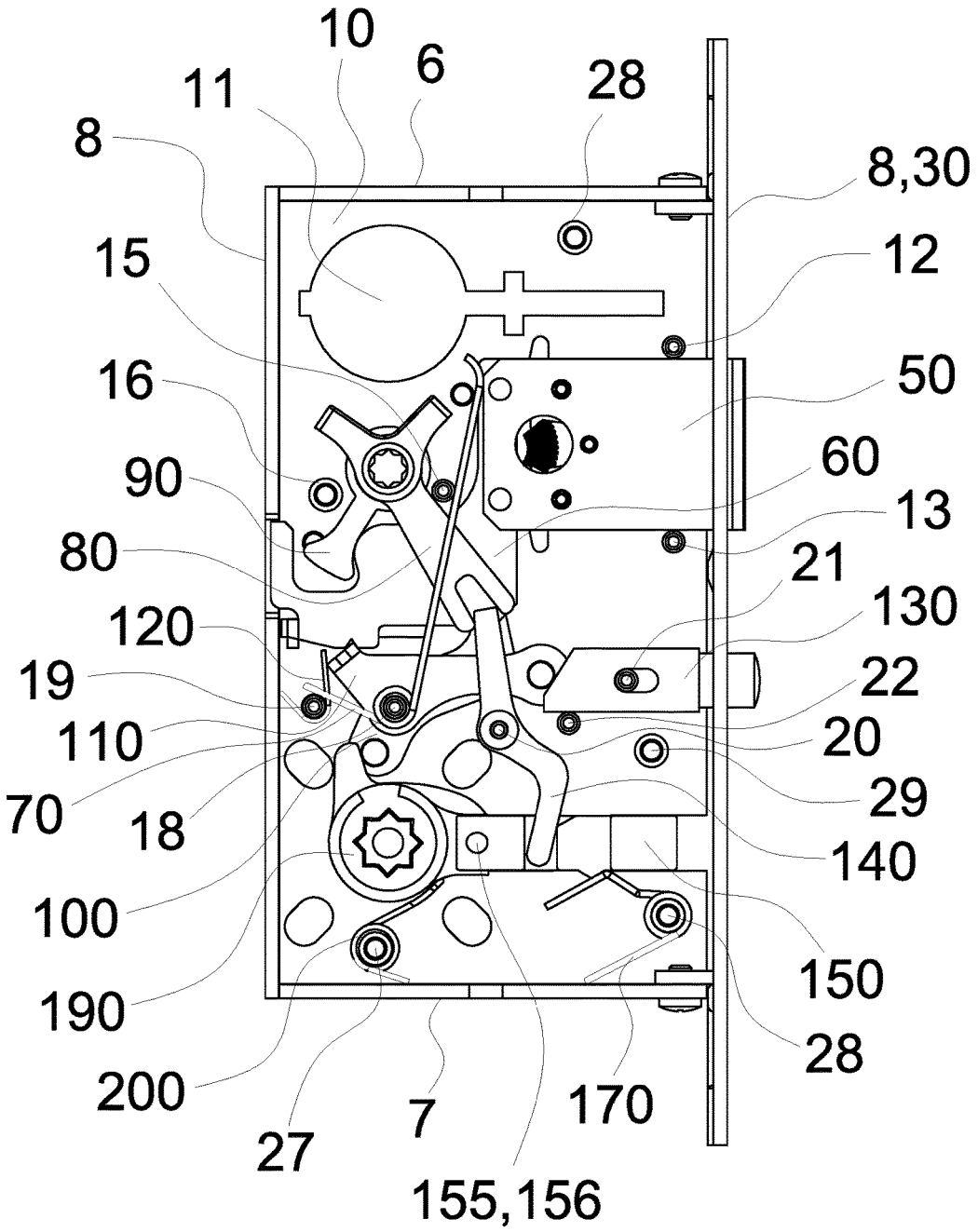
FIG. 7A is a side elevation view of the second side of auto-latching/locking mortise lock for sliding door with the mortise housing cover plate removed, the deadbolt in the retracted position, and the lock block in the locked position.
Figure 8:
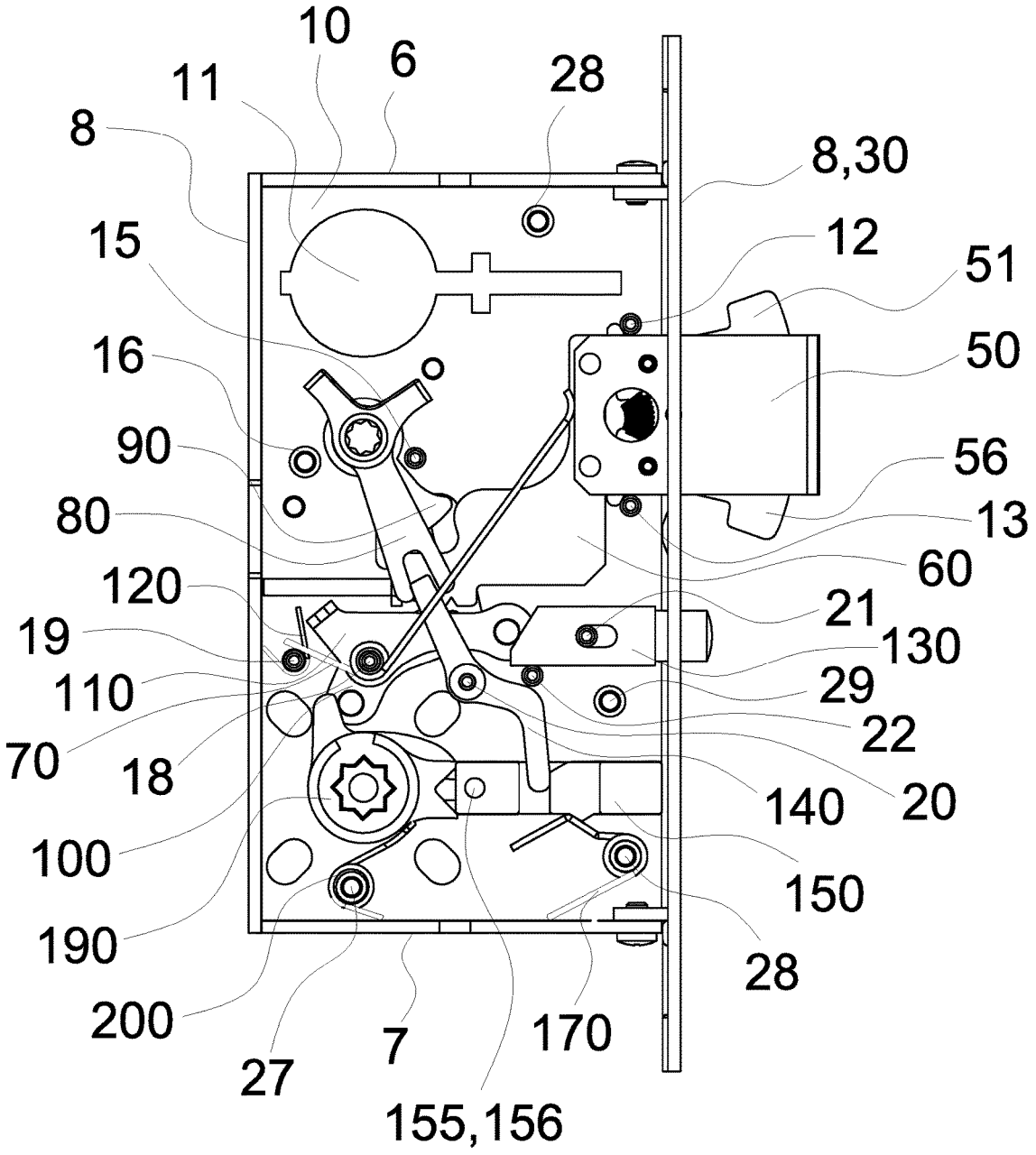
FIG. 8 is a side elevation view of the second side of auto-latching/locking mortise lock for sliding door with the mortise housing cover plate removed, the deadbolt in the extended position, and the lock block in the unlocked position.
Figure 9:
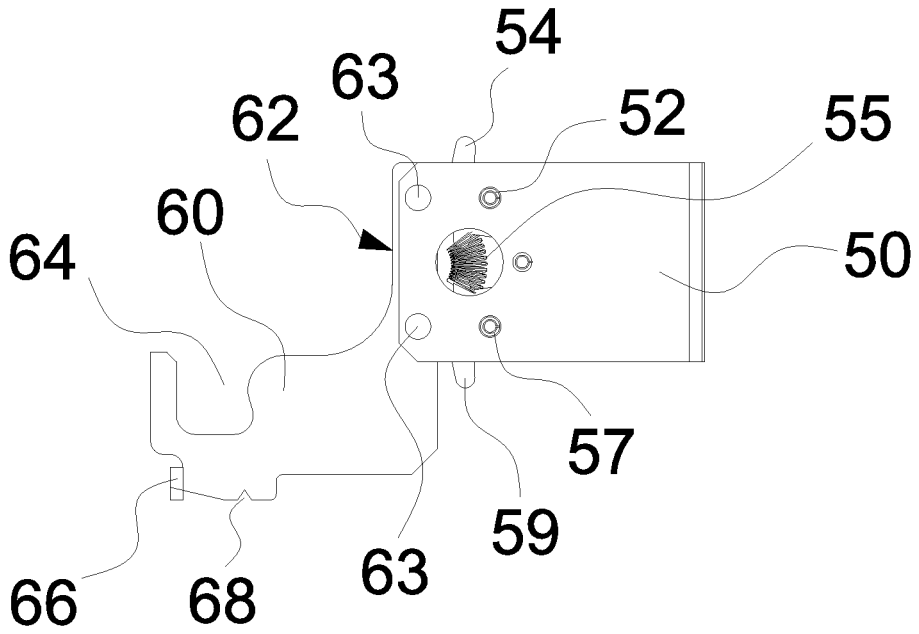
FIG. 9 is an enlarged view of deadbolt and deadbolt shaft.
Figure 10:
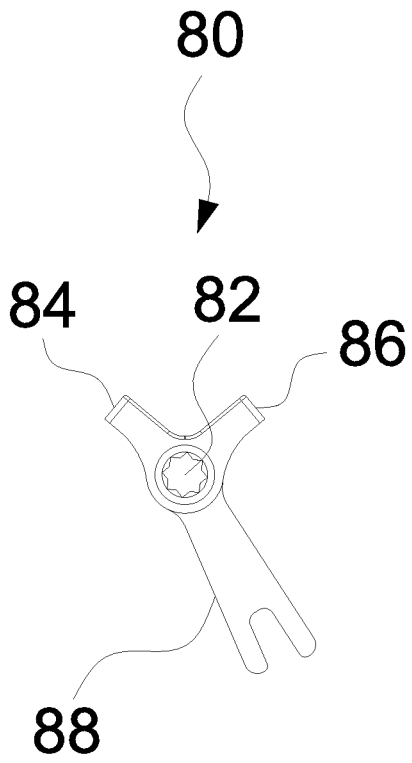
FIG. 10 is an enlarged view of T-turn hub.
Figure 11:
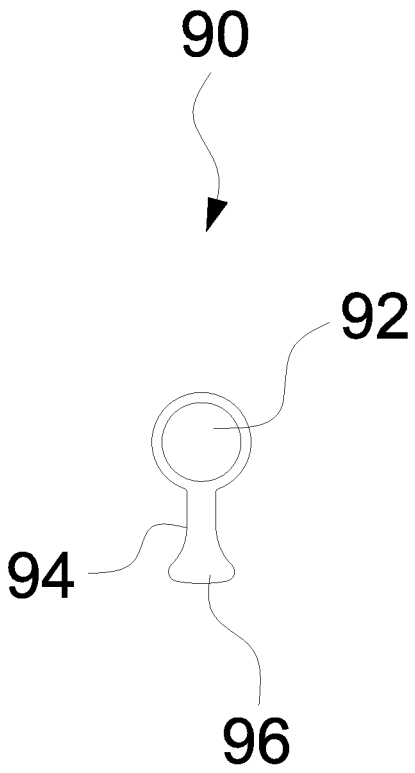
FIG. 11 is an enlarged view of bolt retraction hub.
Figure 12:
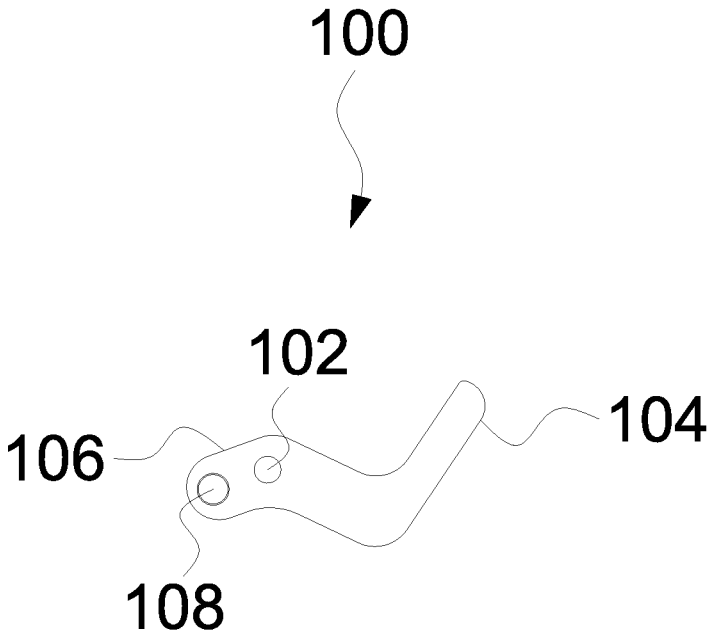
FIG. 12 is an enlarged view of bolt retraction lever.
Figure 13:
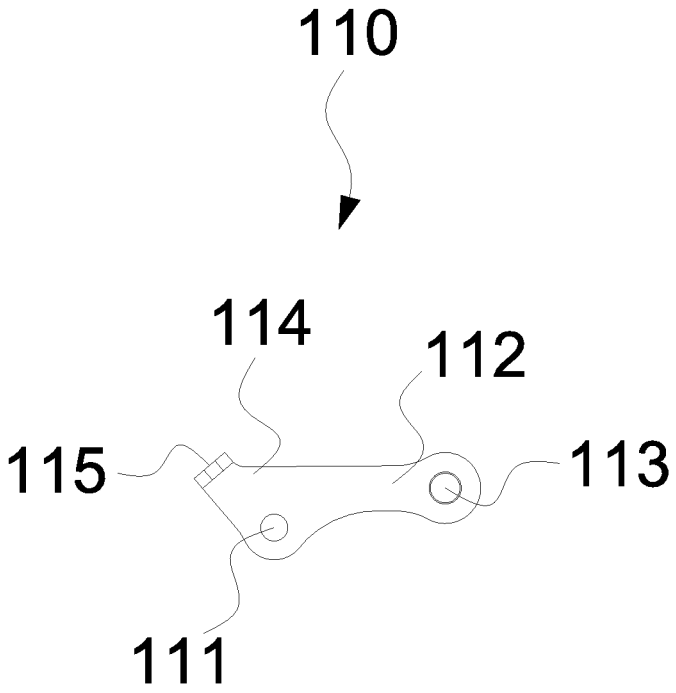
FIG. 13 is an enlarged view of trigger lever.
Figure 14:
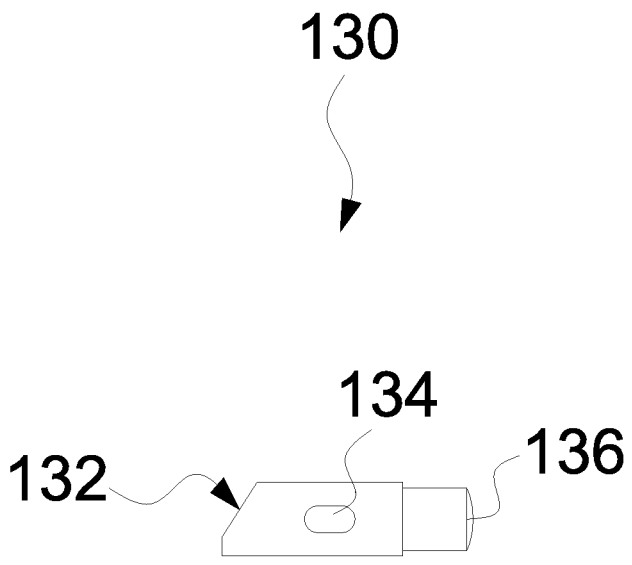
FIG. 14 is an enlarged view of the second side of bolt release actuator.
Figure 15:
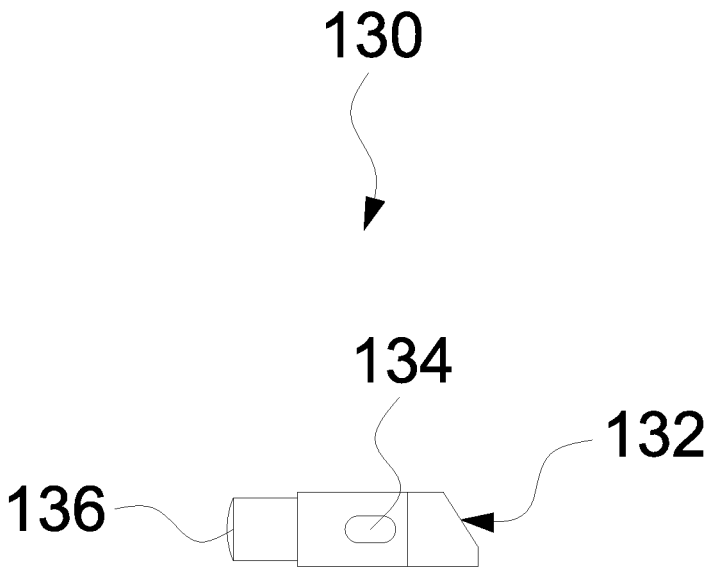
FIG. 15 is an enlarged view of the first side of bolt release actuator.
Figure 16:
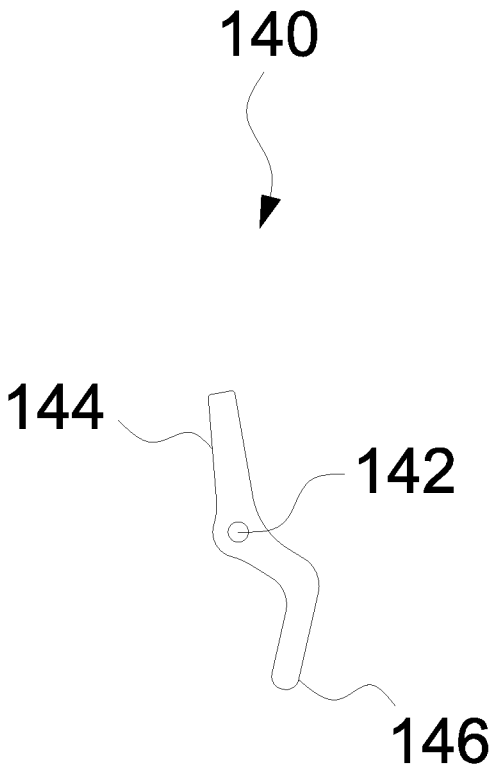
FIG. 16 is an enlarged view of lock block lever.
Figure 17:
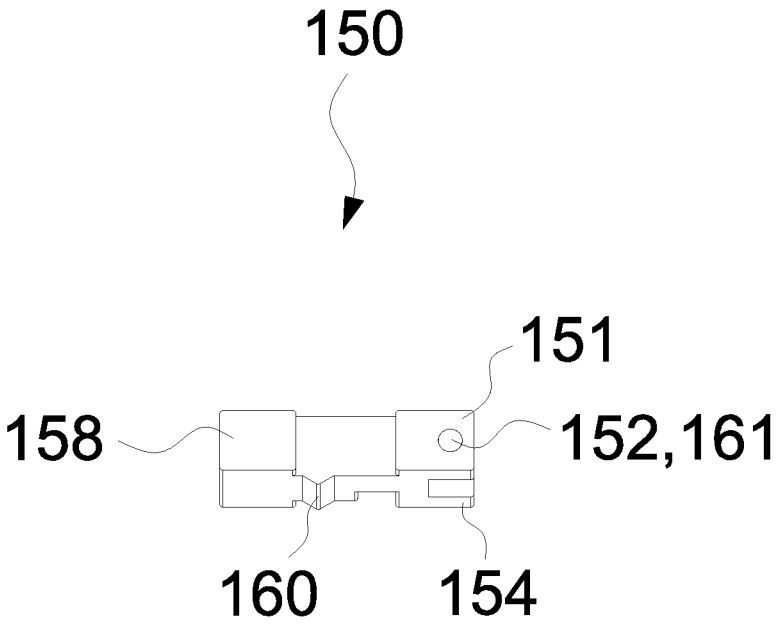
FIG. 17 is an enlarged view of an embodiment of lock block with lock block pins.
Figure 18:
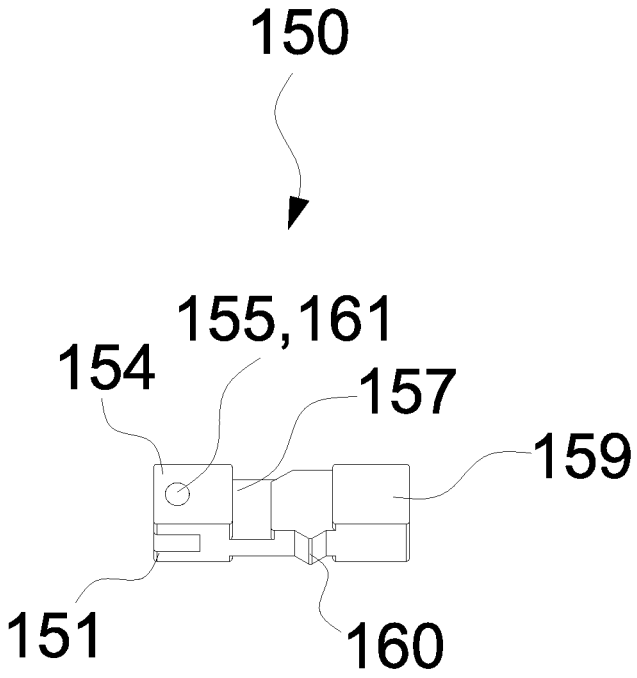
FIG. 18 is an enlarged view of an embodiment of lock block with lock block pins.
Figure 19:
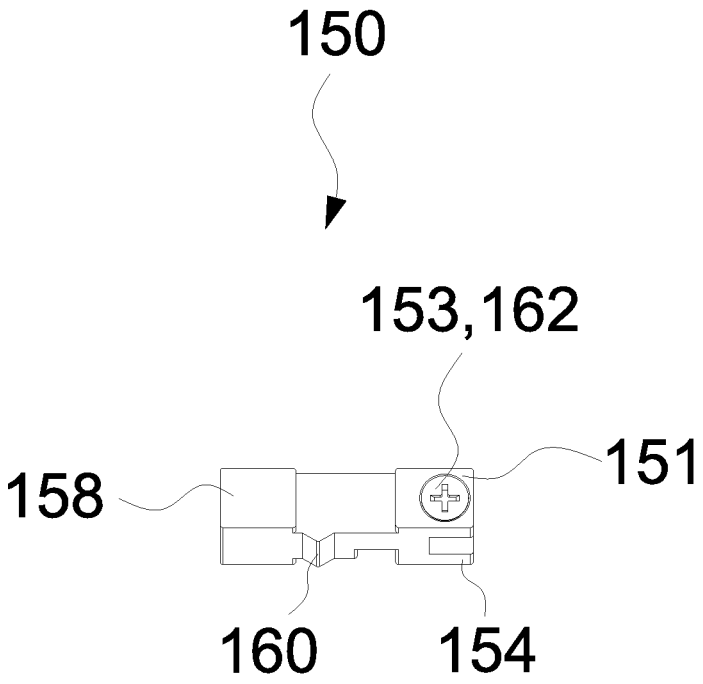
FIG. 19 is an enlarged view of an embodiment of lock block with lock block screws.
Figure 20:
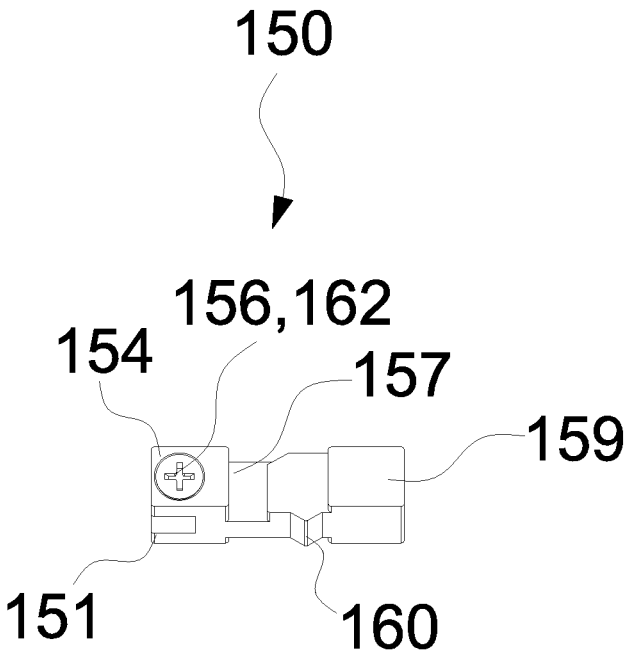
FIG. 20 is an enlarged view of an embodiment of lock block with lock block screws.
Figure 21:
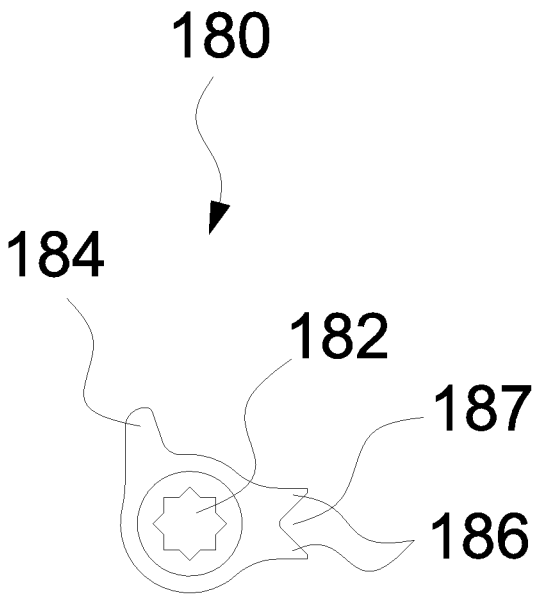
FIG. 21 is an enlarged view of the second side of an embodiment of first lever hub with V-shaped notch.
Figure 22:
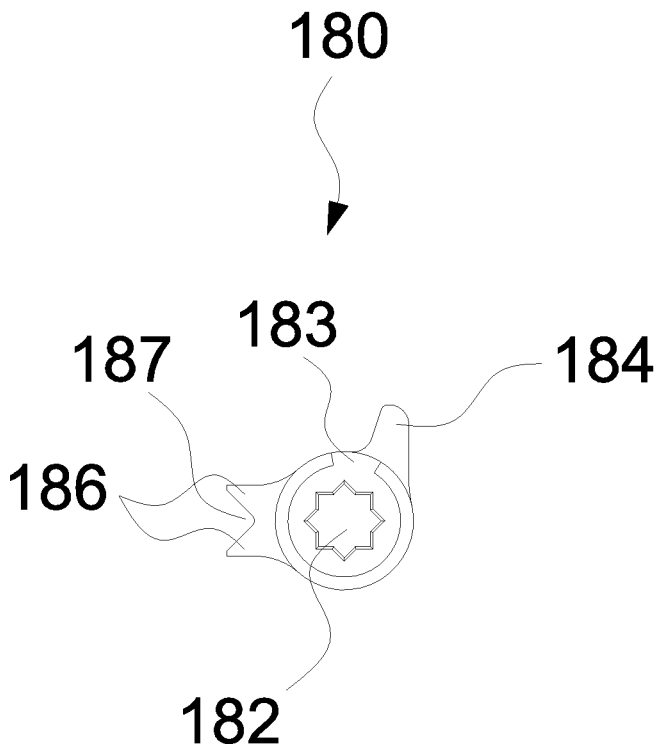
FIG. 22 is an enlarged view of the first side of an embodiment of first lever hub with V-shaped notch.
Figure 23:
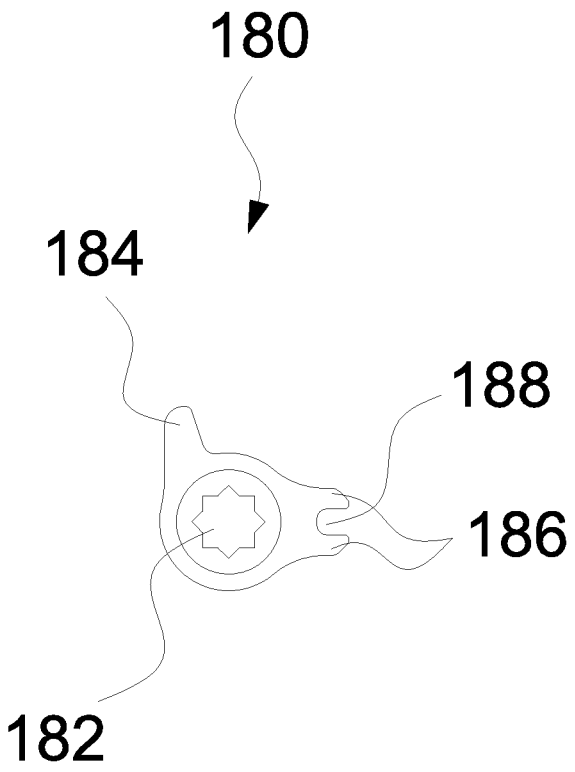
FIG. 23 is an enlarged view of the second side of an embodiment of first lever hub with U-shaped notch.
Figure 24:
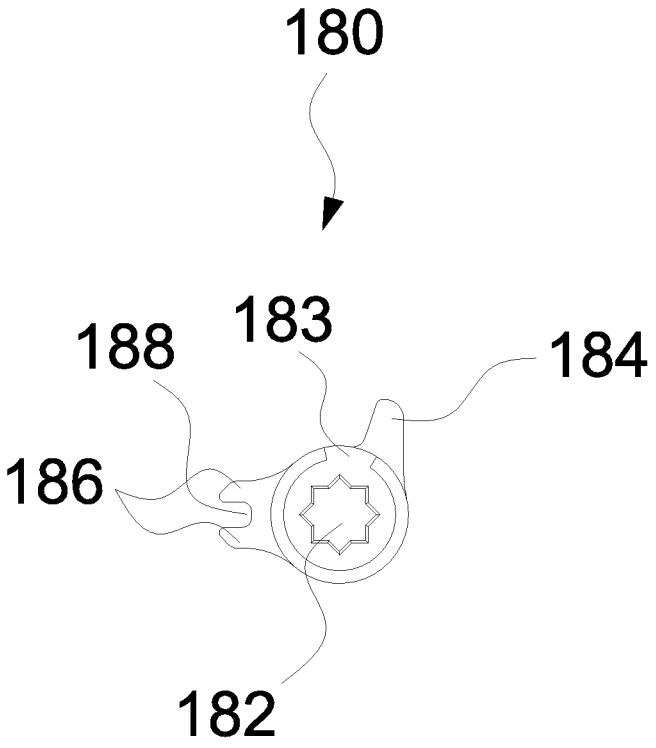
FIG. 24 is an enlarged view of the first side of an embodiment of first lever hub with U-shaped notch.
Figure 25:
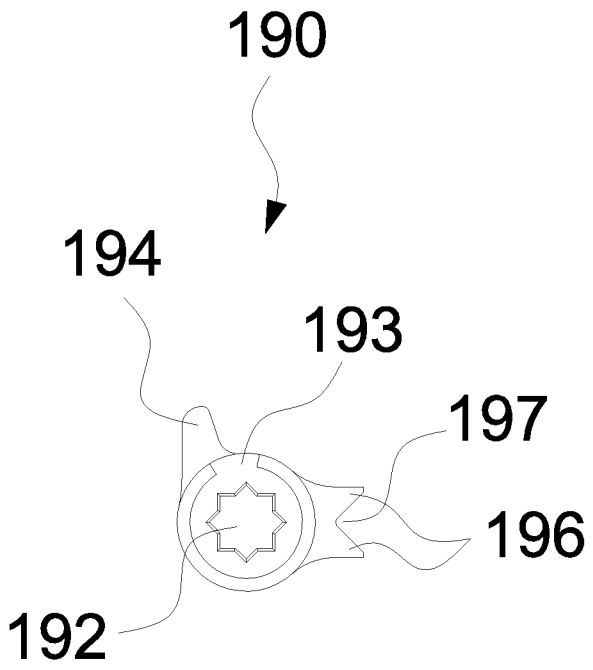
FIG. 25 is an enlarged view of the second side of an embodiment of second lever hub with V-shaped notch.
Figure 26:
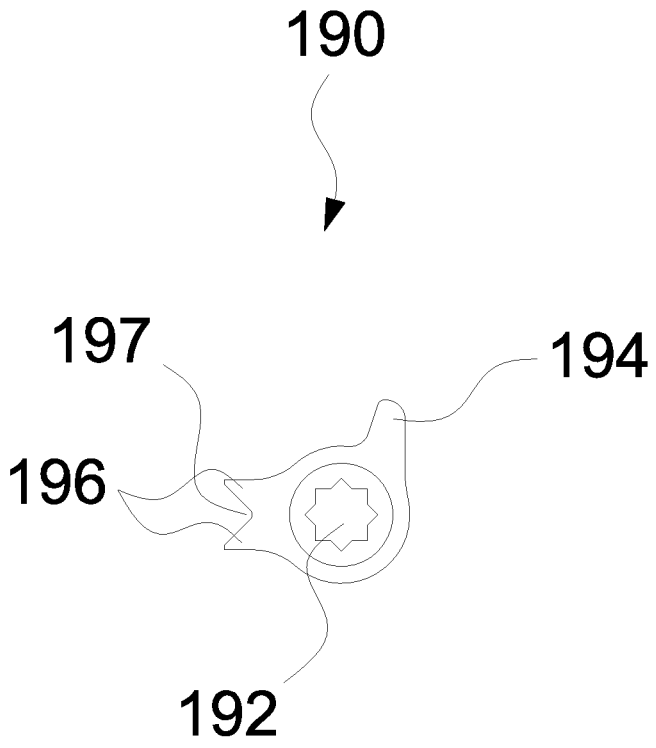
FIG. 26 is an enlarged view of the first side of an embodiment of second lever hub with V-shaped notch.
Figure 27:
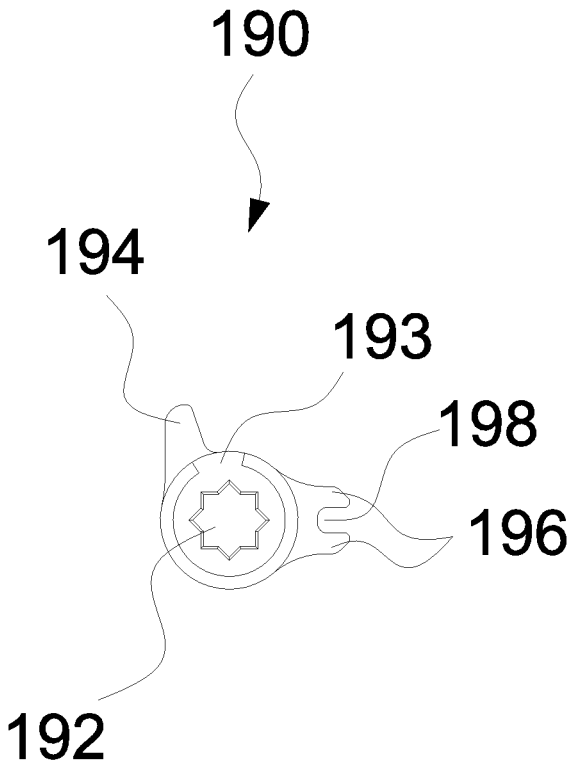
FIG. 27 is an enlarged view of the second side of an embodiment of second lever hub with U-shaped notch.
Figure 28:
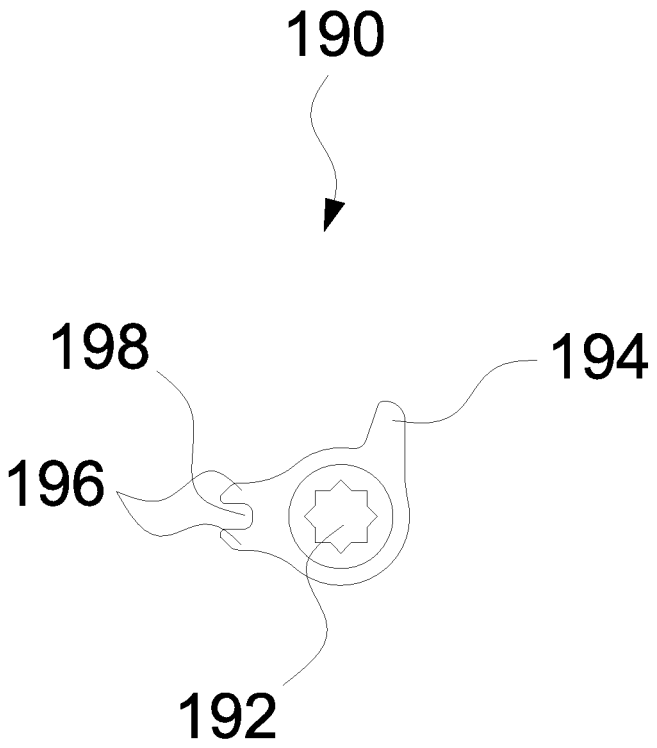
FIG. 28 is an enlarged view of the first side of an embodiment of second lever hub with U-shaped notch.

Mortise housing base 10, mortise housing face plate 30, and mortise housing cover plate 40 are attached together, as discussed below, to form a rigid hollow box shaped member or a rectangular cuboid shaped case or housing that encases and holds all other components of auto-latching/locking mortise lock for sliding door 2, as depicted in FIGS. 1 and 2. The rigid hollow box shaped member or rectangular cuboid shaped case or housing has a width, a length, and a thickness. The rigid hollow box shaped member or rectangular cuboid shaped case or housing has a vertical axis running parallel to its length dimension and a horizontal axis running parallel to its width dimension. The rigid hollow box shaped member or rectangular cuboid shaped case or housing is installed within a pocket or mortise cut into opening side of the sliding door. The rigid hollow box shaped member or rectangular cuboid shaped case or housing is installed with its vertical axis running vertically and parallel with the vertical axis of the sliding door and its horizontal axis running horizontally and parallel with the horizontal axis of the sliding door. The rigid hollow box shaped member or rectangular cuboid shaped case or housing contains a complicated assembly of various mechanical actions that control the mortise lockset and allow the mortise lockset to function. The complicated assembly of mechanical actions causes the deadbolt 50 and button 136 to protrude and retract from mortise housing base 10 at various times during operation of the mortise lockset.

The rigid hollow box shaped member or rectangular cuboid shaped case or housing has a first side 4, a second side 5, an upper side 6, a lower side 7, an opening side 8, and a retracting side 9. First side 4 and second side 5 are the two large vertical sides of auto-latching/locking mortise lock for sliding door 2 that are parallel with the inward side and the outward side of the sliding door. Auto-latching/locking mortise lock for sliding door 2 may be installed with its first side 4 adjacent to the inward side or the outward side of the sliding door. As discussed below, this allows for a single embodiment of auto-latching/locking mortise lock for sliding door 2 to be installed in either a "left opening" sliding door or a "right opening" sliding door. The upper side 6 is the horizontal side of auto-latching/locking mortise lock for sliding door 2 that is most proximate to the ceiling of the room with auto-latching/locking mortise lock for sliding door 2 installed in the sliding door. The lower side 7 is the horizontal side of auto-latching/locking mortise lock for sliding door 2 that is most proximate to the floor of the room with auto-latching/locking mortise lock for sliding door 2 installed in the sliding door. The opening side 8 is the vertical side of auto-latching/locking mortise lock for sliding door 2 that aligns with or is flush with the opening side of the sliding door with auto-latching/locking mortise lock for sliding door 2 installed in the sliding door. As discussed below, opening side 8 of auto-latching/locking mortise lock for sliding door 2 butts up against or contacts the door jamb or wall when the sliding door is closed and deadbolt 50 and button 136 protrude and retract from opening side 8. The retracting side 9 is the vertical side of auto-latching/locking mortise lock for sliding door 2 that is opposite from the opening side 8 and deepest in the a pocket or mortise of the sliding door into which the auto-latching/locking mortise lock for sliding door 2 is installed. This convention or system of naming sides and edges is carried on throughout this application.

Auto-latching/locking mortise lock for sliding door 2 comprises: a mortise housing base 10; a mortise housing face plate 30; a mortise housing cover plate 40; a plurality of mortise housing screws 49; a deadbolt 50; a deadbolt shaft 60; a deadbolt spring 70; a T-turn hub 80; a bolt retraction hub 90; a bolt retraction lever 100; a trigger lever 110; a trigger lever spring 120; a bolt release actuator 130; a lock block lever 140; a lock block 150; a lock block spring 170; a first lever hub 180; a second lever hub 190; and a lever hub spring 200.

Mortise housing base 10 comprises: a first side, an upper side, a lower side, and a retracting side. Mortise housing base 10 is rigid hollow four-sided rectangular cuboid or box-shaped member with two missing sides. First side of mortise housing base 10 is the first side 4 of auto-latching/locking mortise lock for sliding door 2. First side of mortise housing base 10 is a rigid rectangular planar member with a length, a width, an inside surface, an outside surface, an upper edge, a lower edge, an opening edge, and a retracting edge. The width of first side of mortise housing base 10 is about 2-6 inches. The length of first side of mortise housing base 10 is about 4-8 inches. Upper side of mortise housing base 10 is the upper side 6 of auto-latching/locking mortise lock for sliding door 2. Upper side of mortise housing base 10 is a rigid rectangular planar member with a length, a width, an inside surface, an outside surface, a first edge, a second edge, an opening edge, and a retracting edge. The width of upper side of mortise housing base 10 is about 0.25 to 2.5 inches. The length of upper side is equal to the width of first side. Lower side of mortise housing base 10 is the lower side 7 of auto-latching/locking mortise lock for sliding door 2. Lower side of mortise housing base 10 is a rigid rectangular planar member with a length, a width, an inside surface, an outside surface, a first edge, a second edge, an opening edge, and a retracting edge. The width of lower side of mortise housing base 10 is about 0.25 to 2.5 inches and equal to that of the upper side. The length of lower side is equal to the width of first side. Retracting side of mortise housing base 10 is the retracting side 9 of auto-latching/locking mortise lock for sliding door 2. Retracting side of mortise housing base 10 is a rigid rectangular planar member with a length, a width, an inside surface, an outside surface, a first edge, a second edge, an upper edge, and a lower edge. The width of retracting side of mortise housing base 10 is about 0.25 to 2.5 inches and equal to that of the upper side. The length of retracting side is equal to the length of first side. Mortise housing base 10 may be made of any known material such as: metal, steel, aluminum, plastic, composite, wood, fiberglass, ceramic, or any other known material.

The upper edge of the first side is rigidly attached to the first edge of upper side so that these members are perpendicular to each other and the opening edge of the first side aligns with the opening edge of the upper side and the retracting edge of the first side aligns with the retracting edge of the upper side. Rigid attachment may be accomplished by any known means such as: brake bending, pressed seam, weld, glue, epoxy, adhesive, bolts, screws, rivets, clips, snaps, pins, or fasteners. In best mode, the first side and the upper side of mortise housing base 10 are made from the same sheet of rigid material that is brake bent at ninety degrees to form the first side. The lower edge of the first side is rigidly attached to the first edge of lower side so that these members are perpendicular to each other and the opening edge of the first side aligns with the opening edge of the lower side and the retracting edge of the first side aligns with the retracting edge of the lower side. Rigid attachment may be accomplished by any known means such as: brake bending, pressed seam, weld, glue, epoxy, adhesive, bolts, screws, rivets, clips, snaps, pins, or fasteners. In best mode, the lower side and the first side of mortise housing base 10 are made from the same sheet of rigid material that is brake bent at ninety degrees to form the lower side. The retracting edge of the first side is rigidly attached to the first side of retracting side so that these members are perpendicular to each other and the upper edge of the first side aligns with the upper edge of the retracting side and the lower edge of the first side aligns with the lower edge of the retracting side. Rigid attachment may be accomplished by any known means such as: brake bending, pressed seam, weld, glue, epoxy, adhesive, bolts, screws, rivets, clips, snaps, pins, or fasteners. In best mode, the retracting side and the first side of mortise housing base 10 are made from the same sheet of rigid material that is brake bent at ninety degrees to form the retracting side.

The first side of mortise housing base 10 contains a plurality structures that are used to mount and retain the various components of auto-latching/locking mortise lock for sliding door 2 as discussed below. The first side of mortise housing base 10 comprises: a lock cylinder mounting hole 11; an upper deadbolt mounting pin 12; a lower deadbolt mounting pin 13; a T-turn hub mounting hole 14; a T-turn hub stop pin 15; a T-turn hub support pillar 16; a deadbolt shaft slot track 17; a trigger lever and bolt retraction lever pivot pin 18; a trigger lever spring pivot pin 19; a lock block lever pivot pin 20; a bolt release actuator slot track pin 21; a bolt release actuator mounting pin 22; a lever hub mounting hole 23; a retracting side lock block slot track 25; a opening side lock block slot track 26; a lever hub spring pivot support pillar 27; and a lock block spring pivot support pillar 28.

Lock cylinder mounting hole 11 is a circular hole in the first side of mortise housing base 10. Lock cylinder mounting hole 11 has a diameter of about 0.5 to 2 inches. Lock cylinder mounting hole 11 is located in the corner of the first side of mortise housing base 10 adjacent to the upper edge and the retracting edge of the first side of mortise housing base 10. Lock cylinder mounting hole 11 in mortise housing base 10 and lock cylinder mounting hole 41 in mortise housing cover plate 40 function to receive, hold, and mount a lock cylinder (not depicted) into auto-latching/locking mortise lock for sliding door 2. A lock cylinder is not an element of this invention but is included for certain versions of auto-latching/locking mortise lock for sliding door 2. A lock cylinder is included with versions of the auto-latching/locking mortise lock for sliding door 2 that require the sliding door to lock on the outside such as with privacy, entry, office, communicating, patio, classroom, or storeroom lock sets. A lock cylinder may be installed or mounted within lock cylinder mounting holes 11, 41. A lock cylinder is a horizontal cylindrical member with an inside end, an outside end, and a swing arm. The inside end is oriented towards the inside or interior of the room. The outside end is oriented toward the outside or exterior of the room. The inside end may have a keyhole that is accessible from the inside of the room. The outside end has a keyhole that is accessible from the outside of the room. A key (not depicted) mates or engages with keyhole to rotate the swing arm on lock cylinder as the key is rotated. The swing arm is located within the interior of auto-latching/locking mortise lock for sliding door 2. The swing arm engages with the first and second lock cylinder catch arms 84,85 on T-turn hub 80 as discussed below. The inside end or the outside end of lock cylinder may be installed within lock cylinder mounting hole 11.

Upper deadbolt mounting pin 12 is a solid rigid horizontal cylindrical member with a diameter, a length, a first end, a second end, and a longitudinal axis. Upper deadbolt mounting pin 12 has a diameter of about 0.0625 to 0.5 inches. The length of upper deadbolt mounting pin 12 is equal to the width of upper side of mortise housing base 10. The first end of upper deadbolt mounting pin 12 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of upper deadbolt mounting pin 12 into a hole in the first side of mortise housing base 10. The second end of upper deadbolt mounting pin 12 has a shoulder that steps down to a smaller diameter than that of the rest of the pin. Upper deadbolt mounting pin 12 is located just above deadbolt 50, as depicted. Upper deadbolt mounting pin 12 contacts deadbolt 50 and helps slideably attach deadbolt 50 to mortise housing base 10 and mortise housing cover plate 40 as discussed below. Upper deadbolt mounting pin 12 also contacts upper deadbolt wing 51 and actuates the rotation of upper deadbolt wing 51 as discussed below.

Lower deadbolt mounting pin 13 is a solid rigid horizontal cylindrical member with a diameter, a length, a first end, a second end, and a longitudinal axis. Lower deadbolt mounting pin 13 has a diameter of about 0.0625 to 0.5 inches. The length of lower deadbolt mounting pin 13 is equal to the width of upper side of mortise housing base 10. The first end of lower deadbolt mounting pin 13 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of upper deadbolt mounting pin 12 into a hole in the first side of mortise housing base 10. The second end of lower deadbolt mounting pin 13 has a shoulder that steps down to a smaller diameter than that of the rest of the pin. Lower deadbolt mounting pin 13 is located just below deadbolt 50, as depicted. Lower deadbolt mounting pin 13 contacts deadbolt 50 and helps slideably attach deadbolt 50 to mortise housing base 10 and mortise housing cover plate 40 as discussed below. Lower deadbolt mounting pin 13 also contacts lower deadbolt wing 56 and actuates the rotation of lower deadbolt wing 56 as discussed below.

T-turn hub mounting hole 14 is a circular hole in the first side of mortise housing base 10. T-turn hub mounting hole 14 has a diameter of about 0.125 to 1.0 inches. T-turn hub mounting hole 14 is located just below lock cylinder mounting hole 11, as depicted. T-turn hub mounting hole 14 in the first side of mortise housing base 10 and T-turn hub mounting hole 42 in mortise housing cover plate 40 function to receive, hold, and mount T-turn hub 80. T-turn hub 80 is pivotally attached to T-turn hub mounting hole 14 in the first side of mortise housing base 10 and T-turn hub mounting hole 42 in mortise housing cover plate 40.

T-turn hub stop pin 15 is a solid rigid horizontal cylindrical member with a diameter, a length, a first end, a second end, and a longitudinal axis. T-turn hub stop pin 15 has a diameter of about 0.0625 to 0.5 inches. The length of T-turn hub stop pin 15 is equal to the width of upper side of mortise housing base 10. The first end of T-turn hub stop pin 15 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of T-turn hub stop pin 15 into a hole in the first side of mortise housing base 10. The second end of T-turn hub stop pin 15 has a shoulder that steps down to a smaller diameter than that of the rest of the pin. T-turn hub stop pin 15 is located adjacent to T-turn hub mounting hole 14 as depicted. T-turn hub stop pin 15 functions to stop the rotation of T-turn hub 80 as the T-turn hub 80 is rotated to slide lock block 150 into the unlocked position as discussed below.

T-turn hub support pillar 16 is a hollow rigid horizontal cylindrical member with an inner diameter, an outer diameter, a length, a first end, a second end, an inside surface, an outside surface, and a longitudinal axis. T-turn hub support pillar 16 has an outer diameter of about 0.125 to 0.75 inches. The length of T-turn hub support pillar 16 is equal to the width of upper side of mortise housing base 10. The first end of T-turn hub support pillar 16 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of T-turn hub support pillar 16 into a hole in the first side of mortise housing base 10. The second end of T-turn hub support pillar 16 is a female threaded fitting connection. The inner diameter on the second end of T-turn hub support pillar 16 is lined with female thread that engages with male thread on a mortise housing screw 49. T-turn hub support pillar 16 and mortise housing screw 49 function to help attach and support mortise housing cover plate 40 to mortise housing base 10 as discussed below. T-turn hub support pillar 16 is located between the retracting edge of the first side of mortise housing base 10 and T-turn hub mounting hole 14, as depicted.

Deadbolt shaft slot track 17 is an oblong hole or slot in the first side of mortise housing base 10. Deadbolt shaft slot track 17 has a width, a length, and a longitudinal axis. The width of deadbolt shaft slot track 17 is about 0.0625 to 0.5 inches. The length of deadbolt shaft slot track 17 is about 0.5 to 2 inches. Deadbolt shaft slot track 17 is located adjacent to the retracting side of mortise housing base 10 with its longitudinal axis perpendicular to the retracting side of mortise housing base 10, as depicted. Deadbolt shaft slot track 17 functions as a slot or a track for a tab 67 on deadbolt shaft 60 to slide within. As discussed below, deadbolt shaft 60 is slideably attached to the first side of mortise housing base 10 by placing tab 67 within deadbolt shaft slot track 17.

Trigger lever and bolt retraction lever pivot pin 18 is a solid rigid horizontal cylindrical member with a diameter, a length, a first end, a second end, and a longitudinal axis. Trigger lever and bolt retraction lever pivot pin 18 has a diameter of about 0.0625 to 0.5 inches. The length of trigger lever and bolt retraction lever pivot pin 18 is equal to the width of upper side of mortise housing base 10. The first end of trigger lever and bolt retraction lever pivot pin 18 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of trigger lever and bolt retraction lever pivot pin 18 into a hole in the first side of mortise housing base 10. The second end of trigger lever and bolt retraction lever pivot pin 18 has a shoulder that steps down to a smaller diameter than that of the rest of the pin. Trigger lever and bolt retraction lever pivot pin 18 is located just below deadbolt shaft slot track 17, as depicted. Trigger lever and bolt retraction lever pivot pin 18 functions to pivotally attach bolt retraction lever 100 and trigger lever 110 to the first side of mortise housing base 10.

Trigger lever spring pivot pin 19 is a solid rigid horizontal cylindrical member with a diameter, a length, a first end, a second end, and a longitudinal axis. Trigger lever spring pivot pin 19 has a diameter of about 0.0625 to 0.5 inches. The length of trigger lever spring pivot pin 19 is equal to the width of upper side of mortise housing base 10. The first end of trigger lever spring pivot pin 19 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of trigger lever and bolt retraction lever pivot pin 18 into a hole in the first side of mortise housing base 10. The second end of trigger lever spring pivot pin 19 has a shoulder that steps down to a smaller diameter than that of the rest of the pin. Trigger lever spring pivot pin 19 is located in between the retraction edge of the first side of mortise housing base 10 and trigger lever and bolt retraction lever pivot pin 18, as depicted. Trigger lever spring pivot pin 19 functions to pivotally attach trigger lever spring 120 to the first side of mortise housing base 10.

Lock block lever pivot pin 20 is a solid rigid horizontal cylindrical member with a diameter, a length, a first end, a second end, and a longitudinal axis. The length of lock block lever pivot pin 20 is equal to the width of upper side of mortise housing base 10. Lock block lever pivot pin 20 has a diameter of about 0.0625 to 0.5 inches. The first end of lock block lever pivot pin 20 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of lock block lever pivot pin 20 into a hole in the first side of mortise housing base 10. The second end of lock block lever pivot pin 20 has a shoulder that steps down to a smaller diameter than that of the rest of the pin. Lock block lever pivot pin 20 is located in between trigger lever and bolt retraction lever pivot pin 18 and bolt release actuator mounting pin 22, as depicted. Lock block lever pivot pin 20 functions to pivotally attach lock block lever 140 to the first side of mortise housing base 10.

Bolt release actuator slot track pin 21 is a solid rigid horizontal cylindrical member with a length, a first end, a second end, and a longitudinal axis. Bolt release actuator slot track pin 21 has a diameter of about 0.0625 to 0.5 inches. The length of bolt release actuator slot track pin 21 is equal to the width of upper side of mortise housing base 10. The first end of bolt release actuator slot track pin 21 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of bolt release actuator slot track pin 21 into a hole in the first side of mortise housing base 10. The second end of bolt release actuator slot track pin 21 has a shoulder that steps down to a smaller diameter than that of the rest of the pin. Bolt release actuator slot track pin 21 is located adjacent to the opening edge of the first side of mortise housing and the button clearance hole 34 on mortise housing face plate 30, as depicted. Bolt release actuator slot track pin 21 functions to help slideably attach or slideably mount bolt release actuator 130 to the first side of mortise housing base 10 and mortise housing face plate 30 as discussed below.

Bolt release actuator mounting pin 22 is a solid rigid horizontal cylindrical member with a diameter, a length, a first end, a second end, and a longitudinal axis. Bolt release actuator mounting pin 22 has a diameter of about 0.0625 to 0.5 inches. The length of bolt release actuator mounting pin 22 is equal to the width of upper side of mortise housing base 10. The first end of bolt release actuator mounting pin 22 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of bolt release actuator mounting pin 22 into a hole in the first side of mortise housing base 10. The second end of bolt release actuator mounting pin 22 has a shoulder that steps down to a smaller diameter than that of the rest of the pin. Bolt release actuator mounting pin 22 is located just under bolt release actuator 130, as depicted. Bolt release actuator mounting pin 22 contacts deadbolt 50. Bolt release actuator mounting pin 22 functions to help slideably attach or slideably mount bolt release actuator 130 to the first side of mortise housing base 10 and mortise housing face plate 30 as discussed below.

Lever hub mounting hole 23 is a circular hole in the first side of mortise housing base 10. Lever hub mounting hole 23 has a diameter of about 0.5 to 2.0 inches. Lever hub mounting hole 23 is located just below trigger lever and bolt retraction lever pivot pin 18, as depicted. Lever hub mounting hole 23 functions to receive, hold, and mount first lever hub 180. First lever hub 180 is pivotally attached to lever hub mounting hole 23 in mortise housing base 10 as discussed below.

Lever hub mounting hole 23 has a key notch 24 on its circumference. Key notch 24 is notch, void, or crenellation in the first side of mortise housing base 10 along the circumference or perimeter of lever hub mounting hole 23. Key notch 24 has a width. Key notch 24 has an opening end and a retracting end. A key tab 183 on first lever hub 180 engages with key notch 24 and nests within key notch 24 to function as a rotation stop or limiter for first lever hub 180 where key tab 183 strikes or contacts the opening end of key notch 24 thereby limiting the rotation of first lever hub 180 in that direction and strikes or contacts the retracting end of key notch 24 thereby limiting the rotation of first lever hub 180 in the other direction.

Retracting side lock block slot track 25 is a rectangular hole in the first side of mortise housing base 10. Retracting side lock block slot track 25 has a width, length, and a longitudinal axis. Retracting side lock block slot track 25 has a width of about 0.25 to 1.0 inches a length of about 0.5 to 1.5 inches. Retracting side lock block slot track 25 is located adjacent to lever hub mounting hole 23 with its longitudinal axis parallel with the planes of the upper and lower sides of mortise housing base 10 and perpendicular to the plane of the retracting side of mortise housing base 10 as depicted. Retracting side and opening side lock block slot tracks 25,26 in mortise housing base 10, along with retracting and opening side lock block slot tracks 45,46 in mortise housing cover plate 40, function to slideably attach or slideably mount lock block 150 to mortise housing base 10 and mortise housing cover plate 40 as discussed below.

Opening side lock block slot track 26 is a rectangular hole in the first side of mortise housing base 10. Opening side lock block slot track 26 has a width, length, and a longitudinal axis. Opening side lock block slot track 26 has a width of about 0.25 to 1.0 inches a length of about 0.5 to 1.5 inches. Opening side lock block slot track 26 is located adjacent to retracting side lock block slot track 25 with its longitudinal axis parallel and concentric with that of retracting side lock block slot track 25 as depicted. Retracting side and opening side lock block slot tracks 25,26 in mortise housing base 10, along with retracting and opening side lock block slot tracks 45,46 in mortise housing base 10, function to slideably attach or slideably mount lock block 150 to mortise housing base 10 and mortise housing cover plate 40 as discussed below.

Lever hub spring pivot support pillar 27 is a hollow rigid horizontal cylindrical member with an inner diameter, an outer diameter, a length, a first end, a second end, an inside surface, an outside surface, and a longitudinal axis. Lever hub spring pivot support pillar 27 has an outer diameter of about 0.125 to 0.75 inches. The length of lever hub spring pivot support pillar 27 is equal to the width of upper side of mortise housing base 10. The first end of lever hub spring pivot support pillar 27 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of lever hub spring pivot support pillar 27 into a hole in the first side of mortise housing base 10. The second end of lever hub spring pivot support pillar 27 is a female threaded fitting connection. The inner diameter on the second end of lever hub spring pivot support pillar 27 is lined with female thread that engages with male thread on a mortise housing screw 49. Lever hub spring pivot support pillar 27 and mortise housing screw 49 function to help attach and support mortise housing cover plate 40 to mortise housing base 10 as discussed below. Lever hub spring pivot support pillar 27 is located between the lever hub mounting hole 23 and the lower side of mortise housing base 10 as depicted.

Lock block spring pivot support pillar 28 is a hollow rigid horizontal cylindrical member with an inner diameter, an outer diameter, a length, a first end, a second end, an inside surface, an outside surface, and a longitudinal axis. Lock block spring pivot support pillar 28 has an outer diameter of about 0.125 to 0.75 inches. The length of lock block spring pivot support pillar 28 is equal to the width of upper side of mortise housing base 10. The first end of lock block spring pivot support pillar 28 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of lever hub spring pivot support pillar 27 into a hole in the first side of mortise housing base 10. The second end of lock block spring pivot support pillar 28 is a female threaded fitting connection. The inner diameter on the second end of lock block spring pivot support pillar 28 is lined with female thread that engages with male thread on a mortise housing screw 49. Lock block spring pivot support pillar 28 and mortise housing screw 49 function to help attach and support mortise housing cover plate 40 to mortise housing base 10 as discussed below. Lock block spring pivot support pillar 28 is located between the opening side lock block slot track 26 and the lower side of mortise housing base 10 as depicted.

The first side of mortise housing base 10 may further comprise one or more other support pillars 29. One or more other support pillars 29 are each a hollow rigid horizontal cylindrical member with an inner diameter, an outer diameter, a length, a first end, a second end, an inside surface, an outside surface, and a longitudinal axis. One or more other support pillars 29 each have an outer diameter of about 0.125 to 0.75 inches. The length of one or more other support pillars 29 is equal to the width of upper side of mortise housing base 10. The first end of each one or more other support pillars 29 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of each of one or more other support pillars 29 into a hole in the first side of mortise housing base 10. The second end of each of one or more other support pillars 29 is a female threaded fitting connection. The inner diameter on the second end of each of one or more other support pillars 29 is lined with female thread that engages with male thread on a mortise housing screw 49. Each of the one or more other support pillars 29 function to help attach and support mortise housing cover plate 40 to mortise housing base 10 as discussed below.

Mortise housing face plate 30 is a rigid rectangular planar member with a length, a width, an inside surface, an outside surface, a first edge, a second edge, an upper edge, and a lower edge. The width of mortise housing face plate 30 is about 0.5 to 2.5 inches and is about 0.5 inches wider than the upper side of mortise housing base 10. The length of mortise housing face plate 30 is about 6-10 inches and is about 2.0 inches longer than the first side of mortise housing base 10.

Mortise housing face plate 30 is reversibly attachable to mortise housing base 10. Mortise housing face plate 30 is attached to mortise housing base 10 with its plane perpendicular to that of the first side of mortise housing base 10, and its first edge aligned with and adjacent to the opening edge of the first side of mortise housing base 10 and its second edge aligned with and adjacent to the opening edge of mortise housing cover plate 40. Reversible attachment may be accomplished by any known means such as: bolts, screws, clips, snaps, pins, fasteners, or any other means. When attached, mortise housing face plate 30 is the opening side 8 of auto-latching/locking mortise lock for sliding door 2. Mortise housing face plate 30 comprises: a deadbolt clearance hole 32 and a button clearance hole 34.

Deadbolt clearance hole 32 is a rectangular or square hole in mortise housing face plate 30. Deadbolt clearance hole 32 has a width of about 0.25 to 1.5 inches and length of about 0.5 to 2.5 inches. Deadbolt clearance hole 32 could also be a circular hole in mortise housing face plate 30. Deadbolt clearance hole 32 has diameter of about 0.5 to 2.5 inches. Deadbolt clearance hole 32 is located in between upper tab flange 36 and a lower tab flange 38. Deadbolt clearance hole 32 functions to provide a clearance hole through face plate 30, through which deadbolt 50 protrudes out of and retracts into in order to latch, unlatch, lock, and/or unlock auto-latching/locking mortise lock for sliding door 2 as discussed below.

Button clearance hole 34 is a circular hole in mortise housing face plate 30. Button clearance hole 34 has diameter of about 0.125 to 2 inches. Button clearance hole 34 could also be a rectangular or square hole in mortise housing face plate 30. Button clearance hole 34 has a width of about 0.25 to 1.5 inches and length of about 0.5 to 2.5 inches. Button clearance hole 34 is located in between upper tab flange 36 and a lower tab flange 38. Button clearance hole 34 functions to provide a clearance hole through face plate 30, through which button 136 on bolt release actuator 130 protrudes out of and retracts into in order to latch, unlatch, lock, and/or unlock auto-latching/locking mortise lock for sliding door 2 as discussed below.

Mortise housing face plate 30 may further comprise: an upper tab flange 36 and a lower tab flange 38. Upper tab flange 36 and lower tab flange 38 function to reversibly attach mortise housing face plate 30 to mortise housing base 10.

Upper tab flange 36 is a tab or flange protruding from the inner surface of mortise housing face plate 30, near the upper edge of mortise housing face plate 30. Upper tab flange 36 is a rigid planar protrusion extending perpendicularly from the inner surface of mortise housing face plate 30. The plane of upper tab flange 36 is parallel to that of the upper side of mortise housing base 10 and perpendicular to plane of mortise housing face plate 30. Upper tab flange 36 has a female threaded or tapped hole 39 running there though. Female threaded or tapped hole 39 engages with male thread on a mortise housing screw 49 to reversibly attach the upper tab flange 36 to the upper side of mortise housing base 10.

Lower tab flange 38 is a tab or flange protruding from the inner surface of mortise housing face plate 30, near the lower edge of mortise housing face plate 30. Lower tab flange 38 is a rigid planar protrusion extending perpendicularly from the inner surface of mortise housing face plate 30. The plane of lower tab flange 38 is parallel to that of the lower side of mortise housing base 10 and perpendicular to plane of mortise housing face plate 30. Lower tab flange 38 has a female threaded or tapped hole 39 running there though. Female threaded or tapped hole 39 engages with male thread on a mortise housing screw 49 to reversibly attach the lower tab flange 38 to the lower side of mortise housing base 10.

Mortise housing cover plate 40 is a rigid rectangular planar member with a length, a width, an inside surface, an outside surface, an upper edge, a lower edge, an opening edge, and a retracting edge. The width of mortise housing cover plate 40 is about 2-6 inches. The length of mortise housing cover plate 40 is about 4-8 inches. Mortise housing cover plate 40 is reversibly attachable to mortise housing base 10. Mortise housing cover plate 40 is attached to mortise housing base 10 with its plane perpendicular to that of the upper and lower sides of mortise housing base 10 and parallel with the first side of mortise housing base 10. Mortise housing cover plate 40 is attached to mortise housing base 10 with its upper edge aligned with and adjacent to the second edge of the upper side of mortise housing base 10, its lower edge aligned with and adjacent to the second edge of the lower side of mortise housing base 10, its retracting edge aligned with and adjacent to the second edge of the retracting side of mortise housing base 10, and its opening edge aligned with and adjacent to the second edge of mortise housing face plate 30. Reversible attachment may be accomplished by any known means such as: bolts, screws, clips, snaps, pins, fasteners, or any other means. When attached, mortise housing cover plate 40 is the second side 5 of auto-latching/locking mortise lock for sliding door 2. Mortise housing cover plate 40 comprises: a lock cylinder mounting hole 41; a T-turn hub mounting hole 42; a lever hub mounting hole 43; a retracting side lock block slot track 45; a opening side lock block slot track 46; a plurality of pin mounting holes 47; and a plurality of screw holes 48.

Lock cylinder mounting hole 41 is a circular hole in mortise housing cover plate 40. Lock cylinder mounting hole 41 has a diameter of about 0.5 to 2 inches. Lock cylinder mounting hole 41 is located in the corner of mortise housing cover plate 40 adjacent to the upper side and the retracting side. Lock cylinder mounting hole 11 in mortise housing base 10 and lock cylinder mounting hole 41 in mortise housing cover plate 40 function to receive, hold, and mount a lock cylinder (not depicted) into auto-latching/locking mortise lock for sliding door 2. A lock cylinder is not an element of this invention but is included for certain versions of auto-latching/locking mortise lock for sliding door 2. A lock cylinder is included with versions of the auto-latching/locking mortise lock for sliding door 2 that require the sliding door to lock on the outside such as with privacy, entry, office, communicating, patio, classroom, or storeroom lock sets. A lock cylinder may be installed or mounted within lock cylinder mounting holes 11, 41. A lock cylinder is a horizontal cylindrical member with an inside end, an outside end, and a swing arm. The inside end is oriented towards the inside or interior of the room. The outside end is oriented toward the outside or exterior of the room. The inside end may have a keyhole that is accessible from the inside of the room. The outside end has a keyhole that is accessible from the outside of the room. A key (not depicted) mates or engages with the keyholes to rotate the swing arm on lock cylinder as the key is rotated. The swing arm is located within the interior of auto-latching/locking mortise lock for sliding door 2. The swing arm engages with the first and second lock cylinder catch arms 84,85 on T-turn hub 80 as discussed below. The inside end or the outside end of lock cylinder may be installed within lock cylinder mounting hole 41.

T-turn hub mounting hole 42 is a circular hole in mortise housing cover plate 40. T-turn hub mounting hole 42 has a diameter of about 0.125 to 1.0 inches. T-turn hub mounting hole 42 is located just below lock cylinder mounting hole 41, as depicted. T-turn hub mounting hole 14 in the first side of mortise housing base 10 and T-turn hub mounting hole 42 in mortise housing cover plate 40 function to receive, hold, and mount T-turn hub 80. T-turn hub 80 is pivotally attached to T-turn hub mounting hole 14 in the first side of mortise housing base 10 and T-turn hub mounting hole 42 in mortise housing cover plate 40.

Lever hub mounting hole 43 is a circular hole in mortise housing cover plate 40. Lever hub mounting hole 43 has a diameter of about 0.5 to 2.0 inches. Lever hub mounting hole 43 is located in the corner of mortise housing cover plate 40 adjacent to the lower side and the retracting side. Lever hub mounting hole 43 in mortise housing cover plate 40 functions to receive, hold, and mount second lever hub 190. Second lever hub 190 is pivotally attached to lever hub mounting hole 43 in mortise housing cover plate 40 as discussed below. Lever hub mounting hole 43 has a key notch 44 on its circumference.

Key notch 44 is notch, void, or crenellation in mortise housing cover plate 40 along the circumference or perimeter of lever hub mounting hole 43. Key notch 44 has a width. Key notch 44 has an opening end and a retracting end. A key tab 193 on second lever hub 190 engages with key notch 44 and nests within key notch 44 to function as a rotation stop for second lever hub 190 where key tab 193 strikes or contacts the one side of key notch 44 thereby limiting the rotation of second lever hub 190 in that direction and strikes or contacts the other side of key notch 44 thereby limiting the rotation of second lever hub 190 in the other direction.

Retracting side lock block slot track 45 is a rectangular hole in mortise housing cover plate 40. Retracting side lock block slot track 45 has a width, length, and a longitudinal axis. Retracting side lock block slot track 45 has a width of about 0.25 to 1.0 inches and a length of about 0.5 to 1.5 inches. Retracting side lock block slot track 45 is located adjacent to lever hub mounting hole 43 with its longitudinal axis parallel with the upper and lower edges of mortise housing cover plate 40 and perpendicular to the retracting edge of mortise housing cover plate 40 as depicted. First and opening side lock block slot tracks 25,26 in mortise housing base 10, along with first and opening side lock block slot tracks 45,46 in mortise housing cover plate 40, function to slideably attach or slideably mount lock block 150 to mortise housing base 10 and mortise housing cover plate 40 as discussed below.

Opening side lock block slot track 46 is a rectangular hole in the first side of mortise housing cover plate 40. Opening side lock block slot track 46 has a width, length, and a longitudinal axis. Opening side lock block slot track 46 has a width of about 0.25 to 1.0 inches and a length of about 0.5 to 1.5 inches. Opening side lock block slot track 46 is located adjacent to retracting side lock block slot track 45 with its longitudinal axis parallel and concentric with that of retracting side lock block slot track 45 as depicted. First and opening side lock block slot tracks 25,26 in mortise housing base 10, along with first and opening side lock block slot tracks 45,46 in mortise housing cover plate 40, function to slideably attach or slideably mount lock block 150 to mortise housing base 10 and mortise housing face plate 30 as discussed below.

Each of the plurality of pin mounting holes 47 is a circular hole in mortise housing cover plate 40. Each of the plurality of pin mounting holes 47 has a diameter of about 0.0625 to 0.5 inches. Each of the plurality of pin mounting holes 47 functions to receive, hold, and mount the second end of a pin, such as: upper deadbolt mounting pin 12, lower deadbolt mounting pin 13, T-turn hub stop pin 15, trigger lever and bolt retraction lever pivot pin 18, trigger lever spring pivot pin 19, lock block lever pivot pin, 20, bolt release actuator slot track pin 21, and bolt release actuator mounting pin 22. The second end of each of these pins forms a slip fit or clearance fit within each of the plurality of pin mounting holes 47 when the mortise housing cover plate 40 is installed onto mortise housing base 10. As stated, the second end of each of these pins has a shoulder that steps down to a smaller diameter that slides or fits into each of the plurality of pin mounting holes 47. When the mortise housing cover plate 40 is installed onto mortise housing base 10, the second ends of upper deadbolt mounting pin 12, lower deadbolt mounting pin 13, T-turn hub stop pin 15, trigger lever and bolt retraction lever pivot pin 18, trigger lever spring pivot pin 19, lock block lever pivot pin, 20, bolt release actuator slot track pin 21, and bolt release actuator mounting pin 22 are flush with the outside surface of mortise housing cover plate 40. This construction adds strength and stability to the pins as they are attached at both their first and second ends.

Each of the plurality of screw holes 48 is a circular hole in mortise housing cover plate 40 with a beveled edge. Each of the plurality of screw holes 48 functions to provide a clearance hole for the first end of a mortise housing screw 49 to pass through and engage with the female thread on a support pillar, such as: T-turn hub support pillar 16, lever hub spring pivot support pillar 27, lock block spring pivot support pillar 28, and one or more other support pillars 29. Each of the plurality of screw holes 48 has an inner diameter of about 0.0625 to 0.5 inches. Each of the plurality of screw holes 48 is located to exactly align with the second end of a support pillar 16,27,28,29. The beveled edge or each screw hole 48 allows the head of each mortise housing screw 49 to be counter sunk into the mortise housing cover plate 40 and flush with the outside surface of mortise housing cover plate 40 when installed.

Each of the plurality of mortise housing screws 49 is a screw, bolt, fastener, clip, or similar. Each of the plurality of mortise housing screws 49 has a first end, a second end, and a longitudinal axis. The first end of each mortise housing screw 49 has male thread that is sized to engage with the female thread on the second end of each support pillar 16,27,28,29. The second end of each mortise housing screw 49 has a head that engages with a tool such as a driver, wrench, socket, bit, or similar. To install mortise housing cover plate 40 to mortise housing base 10, mortise housing cover plate 40 is aligned with mortise housing base 10 and placed onto mortise housing base 10 so that the second ends of a support pillar 16,27,28,29 align with a pin mounting hole 47 and are inserted therein, and the second ends of each support pillar 16,27,28,29 align with a screw hole 48, wherein mortise housing screws 49 are installed and tighten down onto support pillars 16,27,28,29. Installing the mortise housing cover plate 40 is the last step to assembling the auto-latching/locking mortise lock for sliding door 2. Before installing the mortise housing cover plate 40, all internal mechanisms and components of auto-latching/locking mortise lock for sliding door 2 must first be installed and the mortise housing face plate 30 must first be installed as discussed below.

Deadbolt 50 is a rigid rectangular cuboid shaped member. Deadbolt 50 has a width of about 0.5-2 inches, a length of about 1-4 inches, and a thickness of about 0.25 to 1 inches. Deadbolt 50 has a first side, a second side, an upper side, a lower side, an opening side, a retracting side, a longitudinal axis, and a longitudinal bisect. The longitudinal axis of deadbolt 50 runs through its opening side and retracting side. Deadbolt 50 is slideably attached to mortise housing base 10 and mortise housing cover plate 40 with its longitudinal axis running horizontally wherein the deadbolt 50 slides back and forth horizontally along its longitudinal axis. Deadbolt 50 has a retracted position and an extended position. In the retracted position, sliding door is unlatched. In the extended position, sliding door is latched. In the retracted and extended positions, the retracting side of deadbolt 50 remains inside of auto-latching/locking mortise lock for sliding door 2. In the retracted and extended positions, the opening side of deadbolt 50 remains outside of auto-latching/locking mortise lock for sliding door 2. In the extended position, deadbolt 50 extends or protrudes through deadbolt clearance hole 32 on mortise housing face plate 30 so that its longitudinal bisect extends beyond deadbolt clearance hole 32 and is outside of auto-latching/locking mortise lock for sliding door 2. In the retracted position, deadbolt 50 retracts through deadbolt clearance hole 32 on mortise housing face plate 30 so that its longitudinal bisect retracts within deadbolt clearance hole 32 and is inside of auto-latching/locking mortise lock for sliding door 2. Deadbolt 50 functions to latch and unlatch sliding door as described below.

Deadbolt 50 is partially hollow with a rectangular cuboid shaped hollow cavity extending from its lower edge to its upper edge. The hollow cavity breaks through the upper side and the lower side of deadbolt 50. The hollow cavity does not break through the first side, second side, or opening side. The hollow cavity may optional break through retracting side to receive the deadbolt attachment arm 62 to provide a grove for a tongue and groove connection with deadbolt shaft 60 as discussed below. The hollow cavity is a smaller rectangular cuboid that is concentric with that of deadbolt 50 with access at the upper and lower sides. This hollow cavity contains a complicated action mechanism or assembly of parts comprising: an upper deadbolt wing 51; an upper deadbolt wing pivot pin 52; an upper deadbolt wing latch protrusion 53; an upper deadbolt wing heel protrusion 54; a deadbolt wing spring 55; an lower deadbolt wing 56; an lower deadbolt wing pivot pin 57; a lower deadbolt wing latch protrusion 58; and a lower deadbolt wing heel protrusion 59. This complicated action mechanism or assembly of parts must first be installed within deadbolt 50 prior to installing deadbolt 50 into mortise housing base 10 and mortise housing cover plate 40. This complicated action mechanism or assembly of parts functions to help extend and retract upper and lower deadbolt wings 51,56 as described below.

Upper deadbolt wing 51 is a rigid oblong member with a first side, a second side, an upper side, a lower side, an opening side, a retracting side, a pivot pin hole, a latch protrusion 53, a heel protrusion 54, and a longitudinal axis. Upper deadbolt wing 51 has a length of about 1 to 3 inches. The longitudinal axis of upper deadbolt wing 51 runs essentially horizontally and parallel with that of deadbolt 50. Latch protrusion 53 is a rigid tab, protrusion, or catch that extends or protrudes upwards from the upper side of upper deadbolt wing 51 adjacent to the opening side of upper deadbolt wing 51. Heel protrusion 54 is a rigid tab, protrusion, or catch that extends or protrudes upwards from the lower side of upper deadbolt wing 51 adjacent to the retracting side of upper deadbolt wing 51. Pivot pin hole is located in the center of upper deadbolt wing 51 in between the latch protrusion 53 and the heel protrusion 54 of upper deadbolt wing 51. Upper deadbolt wing 51 is pivotally attached within the hollow cavity of deadbolt 50 with upper deadbolt wing pivot pin 52 inserted through pivot pin hole in upper deadbolt wing 51. Upper deadbolt wing 51 is a fulcrum member that pivots about upper deadbolt wing pivot pin 52 like a teeter totter. Latch protrusion 53 pivots upwards to catch within a strike plate (not depicted) in a door jamb (not depicted) in order to latch sliding door with deadbolt 50 in the extended position. Latch protrusion 53 pivots downwards to clear the strike plate in a door jamb in order to unlatch the sliding door.

Lower deadbolt wing 56 is a rigid oblong member with a first side, a second side, an upper side, a lower side, an opening side, a retracting side, a pivot pin hole, a latch protrusion 58, a heel protrusion 59, and a longitudinal axis. Lower deadbolt wing 56 has a length of about 1 to 3 inches. The longitudinal axis of lower deadbolt wing 56 runs essentially horizontally and parallel with that of deadbolt 50. Latch protrusion 58 is a rigid tab, protrusion, or catch that extends or protrudes downwards from the lower side of lower deadbolt wing 56 adjacent to the opening side of lower deadbolt wing 56. Heel protrusion 59 is a rigid tab, protrusion, or catch that extends or protrudes downwards from the lower side of lower deadbolt wing 56 adjacent to the retracting side of lower deadbolt wing 56. Pivot pin hole is located in the center of lower deadbolt wing 56 in between the latch protrusion 58 and the heel protrusion 59 of lower deadbolt wing 56. Lower deadbolt wing 56 is pivotally attached within the hollow cavity of deadbolt 50 with lower deadbolt wing pivot pin 57 inserted through pivot pin hole in lower deadbolt wing 56. Lower deadbolt wing 56 is a fulcrum member that pivots about lower deadbolt wing pivot pin 57 like a teeter totter. Latch protrusion 58 pivots downwards to catch within a strike plate (not depicted) in a door jamb (not depicted) in order to latch sliding door with deadbolt 50 in the extended position. Latch protrusion 58 pivots upwards to clear the strike plate in a door jamb in order to unlatch the sliding door.

Deadbolt wing spring 55 is a compression spring with an upper end, a lower end, and a longitudinal axis. Deadbolt wing spring 55 is installed between upper and lower deadbolt wings 51,56. Upper deadbolt wing 51 is installed in the hollow cavity of deadbolt 50 through the hole in the upper side of deadbolt 50 and pivotally attached to deadbolt 50 with upper deadbolt wing pivot pin 52. Lower deadbolt wing 56 is installed in the hollow cavity of deadbolt 50 through the hole in the lower side of deadbolt 50 and pivotally attached to deadbolt 50 with lower deadbolt wing pivot pin 57. Deadbolt wing spring 55 is installed in the hollow cavity of deadbolt 50 with its longitudinal axis running vertically with its upper end in contact with the lower side of upper deadbolt wing 51 and its lower end in contact with the upper side of lower deadbolt wing 56. There may be a window into the hollow cavity on the first and second sides of deadbolt 50, as depicted, to help with the installation deadbolt wing spring 55 in between upper and lower deadbolt wings 51,56. Deadbolt wing spring 55 is installed on the retracting side of upper and lower deadbolt wing pivot pins 52,57 and thus creates bias spring pressure that rotates or extends upper deadbolt heel protrusion 54 upwards and lower deadbolt heel protrusion 59 downwards.

Upper deadbolt wing latch protrusion 53 is actuated to rotate upwards by heel protrusion 54 contacting upper deadbolt mounting pin 12 as deadbolt 50 extends out of deadbolt clearance hole 32. When deadbolt 50 is in the retracted position, heel protrusion 54 is not in contact with upper deadbolt mounting pin 12 and deadbolt wing spring 55 forces the retracting side of upper deadbolt wing 51 upwards to retract upper deadbolt wing latch protrusion 53 within the hollow cavity of deadbolt 50. When deadbolt 50 is in the extended position, heel protrusion 54 is in contact with upper deadbolt mounting pin 12, which pushes the retracting side of upper deadbolt wing downwards to extend upper deadbolt wing latch protrusion 53 out of the hollow cavity of deadbolt 50.

Lower deadbolt wing latch protrusion 58 is actuated to rotate downwards by heel protrusion 59 contacting lower deadbolt mounting pin 13 as deadbolt 50 extends out of deadbolt clearance hole 32. When deadbolt 50 is in the retracted position, heel protrusion 59 is not in contact with lower deadbolt mounting pin 13 and deadbolt wing spring 55 forces the retracting side of lower deadbolt wing 56 downwards to retract lower deadbolt wing latch protrusion 58 within the hollow cavity of deadbolt 50. When deadbolt 50 is in the extended position, heel protrusion 59 is in contact with lower deadbolt mounting pin 13, which pushes the retracting side of lower deadbolt wing upwards to extend lower deadbolt wing latch protrusion 58 out of the hollow cavity of deadbolt 50.

Deadbolt shaft 60 is a rigid oblong planar member with a first side, a second side, an upper edge, a lower edge, an opening edge, a retracting edge, and a longitudinal axis. Deadbolt shaft 60 has a width of about 0.5 to 2 inches. Deadbolt shaft 60 has a length of about 1 to 3 inches. Deadbolt shaft 60 functions to rigidly attach to deadbolt 50 and slideably attach to the first side of mortise housing base 10. Deadbolt shaft comprises: a deadbolt attachment arm 62; a pendulum arm pocket 64; a tab 66; and a trigger lever notch 68.

Deadbolt attachment arm 62 is a long planar protrusion or arm member protruding from the upper edge of deadbolt shaft 60 adjacent to the opening edge of deadbolt shaft 60. Deadbolt attachment arm 62 has a length equal to the width of deadbolt 50. Deadbolt attachment arm 62 is in the same plane as that of deadbolt shaft 60. Deadbolt attachment arm 62 is rigidly attached to the retracting side of deadbolt 50. Rigid attachment may be accomplished by any known means such as: pressed fit, pressed seam, weld, glue, epoxy, adhesive, bolts, screws, rivets, clips, snaps, pins, or fasteners. In best mode, rigid attachment is done with pins. In best mode, deadbolt 50 has two pin holes adjacent to the retracted edge of deadbolt 50. In best mode, deadbolt attachment arm 62 has two pin holes that align with the pin holes on deadbolt 50. Each pin hole is a circular hole that functions to receive a deadbolt attachment pin 63 to rigidly attach deadbolt attachment arm 62 to deadbolt 50. Each deadbolt attachment pin 63 is a rigid cylindrical member sized to make slip fit or press fit within the pin holes on deadbolt attachment arm 62 and deadbolt 50. In best mode, deadbolt attachment arm is inserted slightly into the hollow cavity at the retracting side of deadbolt 50 and then pinned, as depicted. This is a pinned tongue and groove joint or rigid connection where deadbolt attachment arm 62 is the tongue and the hollow cavity in deadbolt 50 is the groove.

Pendulum arm pocket 64 is a void or hole in deadbolt shaft 60. Pendulum arm pocket 64 is rectangular or square shaped notch or void taken out of the upper edge of deadbolt shaft 60, adjacent to the retracted edge of deadbolt shaft 60. Pendulum arm pocket 64 does not break through the retracted edge of deadbolt shaft 60. Pendulum arm pocket 64 functions to receive and hold within it, the lower end of pendulum arm 94 of bolt retraction hub 90 as discussed below. The lower end of pendulum arm 94 of bolt retraction hub 90 rides within pendulum arm pocket 64 to cause the bolt retraction hub 90 to rotate as deadbolt shaft 60 slides back and forth horizontally and vice versa.

Tab 66 on deadbolt shaft 60 is a rigid tab, protrusion, or catch that extends or protrudes perpendicularly outwards from the first side of deadbolt shaft 60, which is the side of deadbolt shaft 60 facing the first side of mortise housing base 10. The plane of tab 66 is parallel with that of the retracting side of mortise housing base 10. Tab 66 functions to help slideably attach deadbolt shaft 60 to the first side of mortise housing base 10. Tab 66 nests within and rides within deadbolt shaft slot track 17 as deadbolt shaft 60 slides back and forth horizontally. The width of tab 66 is sized to make a slip fit with the width of deadbolt shaft slot track 17.

Trigger lever notch 68 is a V-shaped notch or void in the lower edge of deadbolt shaft 60. Trigger lever notch 68 functions to receive and hold a catch tab 115 on trigger lever 110. As discussed below, trigger lever 110 is spring biased to push or rotate the second arm 114 upwards toward the upper side of mortise housing base 10. This spring bias pushes pin 113 downwards to push bolt release actuator 130 toward the mortise housing face plate 30 or in the extended position. Deadbolt 50 and deadbolt shaft 60 are also spring biased to push or slide deadbolt 50 and deadbolt shaft 60 toward the mortise housing cover plate 40. This spring bias pushes deadbolt 50 and deadbolt shaft 60 toward the mortise housing cover plate 40 or in the extended position. When deadbolt 50 is retracted, the lower edge of deadbolt shaft 60 slides along the catch tab 115 but catches within trigger lever notch 68 when trigger lever notch 68 slides over catch tab 115. The trigger lever notch 68 captures and holds catch tab 115 to prevent the spring bias from extending deadbolt 50 by latching or locking the deadbolt 50 in the retracted position.

Deadbolt spring 70 is a torsion spring. Deadbolt spring 70 has a center, a first side arm, and a second arm. The center of deadbolt spring 70 is mounted on trigger lever and bolt release lever pivot pin 18. The first arm of deadbolt spring 70 extends all the way up to contact the retracting side of deadbolt 50. The second arm of deadbolt spring 70 extends to contact trigger lever spring pivot pin 19. Deadbolt spring 70 functions to apply constant spring bias or spring pressure to push bolt release actuator 130 toward the mortise housing cover plate 40 or in the extended position and push the second arm 114 on trigger lever 110 upwards.

T-turn hub 80 is a hub or center of a wheel or rotating member. T-turn hub 80 is a rigid member. T-turn hub 80 comprises: a socket 82; a first lock cylinder catch arm 84; a second lock cylinder catch arm 86; and a fork arm 88. Socket 82 is a hole through the center of T-turn hub 80. First lock cylinder catch arm 84, second lock cylinder catch arm 86, and fork arm 88 are each rigid protrusions or arms that extends radially outward from socket 82. T-turn hub 80 functions to transfer rotational motion from a swing arm on a lock cylinder to rotational motion on lock block lever 140.

Socket 82 is a rigid cylindrical hole through T-turn hub 80. Socket 82 has open ends. Socket 82 runs thorough the center of T-turn hub 80. Socket 82 has a first end, a second end, an inner diameter, an inner surface, an outer diameter, an outer surface, and a longitudinal axis. T-turn hub 80 is pivotally attached to the first side of mortise housing base 10 at the first end of socket 82 and pivotally attached to mortise housing cover plate 40 at the second end of socket 82 so that the longitudinal axis of socket 82 is perpendicular to the planes of first side of mortise housing base 10 and mortise housing cover plate 40. The outer diameter of socket 82 is sized to make a slip fit with the diameter of T-turn hub mounting hole 14 and T-turn hub mounting hole 42. The outer surface of socket 82 is smooth. The inner surface of socket 82 has a plurality of points or ridges that function to engage with a square spindle or shaft from a thumb turn (not depicted) or coin turn (not depicted). A spindle or shaft from a thumb turn or coin turn may be inserted and installed through socket 82 to form a connection therewith so that T-turn hub 80 rotates along with the spindle or shaft from a thumb turn or coin turn. A thumb turn or coin turn is not an element of auto-latching/locking mortise lock for sliding door 2 but is included with a mortise lock set.

First lock cylinder catch arm 84 is a rigid oblong member or arm protruding radially outward from the exterior surface of socket 82. When T-turn hub 80 is pivotally attached properly, first lock cylinder catch arm 84 extends in the direction pointing towards the opening edge of the upper side of mortise housing base 10. First lock cylinder catch arm 84 has an overall length of about 0.25 to 1.5 inches.

Second lock cylinder catch arm 86 is a rigid oblong member or arm protruding radially outward from the exterior surface of socket 82. When T-turn hub 80 is pivotally attached properly, second lock cylinder catch arm 86 extends in the direction pointing towards the retracting edge of the upper side of mortise housing base 10. Second lock cylinder catch arm 86 has an overall length of about 0.25 to 1.5 inches.

First and second cylinder catch arms 84,86 engage with a swing arm (not depicted) on a lock cylinder (not depicted) to rotate T-turn hub 80 as the swing arm on lock cylinder is rotated. When a key or thumb turn rotates lock cylinder, the swing arm on lock cylinder is also rotated, which contacts or collides with first lock cylinder catch arm 84 when rotated in one direction and contacts or collides with second lock cylinder catch arm 86 when rotated in the other direction. Thus, when installed into auto-latching/locking mortise lock for sliding door 2, lock cylinder functions to rotate T-turn hub 80.

Fork arm 88 is a rigid oblong member or arm protruding radially outward from the exterior surface of socket 82. When T-turn hub 80 is pivotally attached properly, fork arm 88 extends in the direction pointing towards the opening edge of the lower side of mortise housing base 10. Fork arm 88 has an overall length of about 0.5 to 2.5 inches. There is a two-tine fork or two-tine fork shaped member on the radial end of fork arm 88. The two tines function to receive and hold the upper arm 104 of bolt retraction lever 100 there between. The upper arm 104 of bolt retraction lever 100 nests within and rides within the two-tine fork so that bolt retraction lever 100 rotates with T-turn hub 80 as T-turn hub 80 is rotated. Fork arm 88 functions to rotate bolt retraction lever 100 as T-turn hub 80 is rotated.

Bolt retraction hub 90 is a hub or center of a wheel or rotating member. Bolt retraction hub 90 is a rigid member. Bolt retraction hub 90 comprises: a socket 92 and a pendulum arm 94. Socket 92 is a hole through the center of bolt retraction hub 90. Pendulum arm 94 is a rigid protrusion or arm that extends radially outward from socket 92. Bolt retraction hub 90 functions to transfer rotational motion from bolt retraction lever 100 to translational motion of deadbolt shaft 60.

Socket 92 is a rigid cylindrical hole through bolt retraction hub 90. Socket 92 has open ends. Socket 92 runs thorough the center of bolt retraction hub 90. Socket 92 has a first end, a second end, an inner diameter, an inner surface, an outer diameter, an outer surface, and a longitudinal axis. Bolt retraction hub 90 is pivotally attached to outer surface of socket 82 on T-turn hub 80 so that the longitudinal axis of socket 92 is concentric with that of socket 82. The inner diameter of socket 92 is sized to make a slip fit with the outer diameter of socket 82. The second end of socket 92 is slid over the first end of socket 82 to attach these members.

Pendulum arm 94 is a rigid oblong member or arm protruding radially outward from the exterior surface of socket 92. When bolt retraction hub 90 is pivotally attached properly, pendulum arm 94 extends in the direction pointing towards the opening edge of the lower side of mortise housing base 10. Pendulum arm 94 has an overall length of about 0.15 to 1.5 inches. There is a head 96 or wide portion on the radial end of pendulum arm 94. Head 96 functions to nest within and ride within pendulum arm pocket 64 in deadbolt shaft 60. With this arrangement, deadbolt shaft 60 slides back and forth within deadbolt shaft slot track 17 as pendulum arm 94 rotates back and forth. Pendulum arm 94 functions to slide deadbolt shaft 60 as pendulum arm 94 is rotated.

Bolt retraction lever 100 is a rigid oblong planar member with a first side, a second side, and a longitudinal axis. Bolt retraction lever 100 is pivotally attached to trigger lever and bolt retraction lever pivot pin 18. Bolt retraction lever 100 comprises: a pivot hole 102; an upper arm 104; a lower arm 106; and a pin 108. Bolt retraction lever 100 functions to transfer rotational motion from first lever hub 180 or second lever hub 190 to rotational motion of bolt retraction hub 90. Bolt retraction lever 100 functions to retract deadbolt 150 to unlatch sliding door.

Pivot hole 102 is a circular hole through bolt retraction lever 100. Pivot hole 102 is located in between upper arm 104 and lower arm 106. Pivot hole 102 is pivotally attached to trigger lever and bolt retraction lever pivot pin 18. Pivot hole 102 has a diameter that is sized to make a slip fit with the diameter of trigger lever and bolt retraction lever pivot pin 18.

Upper arm 104 is a rigid oblong member or arm protruding radially outward from pivot hole 102. When bolt retraction lever 100 is pivotally attached properly, upper arm 104 extends in the direction essentially pointing towards the upper side of mortise housing base 10. Upper arm 104 has a length of about 1 to 2 inches. Upper arm 104 "dog legs" or bends toward the retracting side of mortise housing base 10 as depicted. Upper arm 104 has a radial end that engages with pendulum arm 94 on bolt retraction hub 90. As bolt retraction lever 100 is rotated by first or second lever hubs 180,190, upper arm 104 contacts pendulum arm 94 and rotates it towards the retracting side of mortise housing base 10. Pendulum arm 94 contacts deadbolt shaft 60 and causes deadbolt shaft 60 to slide towards the retracting side of mortise housing base 10, which causes deadbolt 50 to retract.

Lower arm 106 is a rigid oblong member or arm protruding radially outward from pivot hole 102. Lower arm 106 has a length of about 0.25 to 1 inches. When bolt retraction lever 100 is pivotally attached properly, lower arm 106 extends in the direction essentially pointing towards the lower side of mortise housing base 10.

Pin 108 is a rigid solid cylindrical member extending from lower arm 106. Pin 108 extends or protrudes perpendicularly outwards from the second side of bolt retraction lever 100, which is the side of bolt retraction lever 100 facing mortise housing cover plate 40. Thus, the longitudinal axis of pin 108 is perpendicular to the plane of bolt retraction lever 100. Pin 108 makes contact with: bolt retraction arm 184 on first lever hub 180 when first lever hub 180 is rotated and bolt retraction arm 194 on second lever hub 190 when second lever hub 190 is rotated. This contact causes bolt retraction lever 100 to rotate as first or second lever hubs 180,190 is rotated.

Trigger lever 110 is a rigid oblong planar member with a first side, a second side, and a longitudinal axis. Trigger lever 110 is pivotally attached to trigger lever and bolt retraction lever pivot pin 18. Trigger lever 110 comprises: a pivot hole 111; a first arm 112; a pin 113; a second arm 114; and a catch tab 115. Trigger lever 110 functions to rotate from contact with bolt release actuator 130 which causes catch tab 115 to catch and release from trigger lever notch 68 on deadbolt shaft 60.

Pivot hole 111 is a circular hole through trigger lever 110. Pivot hole 111 is located in between first arm 112 and second arm 114. Pivot hole 111 is pivotally attached to trigger lever and bolt retraction lever pivot pin 18. Pivot hole 111 has a diameter that is sized to make a slip fit with the diameter of trigger lever and bolt retraction lever pivot pin 18.

First arm 112 is a rigid oblong member or arm protruding radially outward from pivot hole 111. First arm 112 has a length of about 1 to 2 inches. When trigger lever 110 is pivotally attached properly, first arm 112 extends in the direction pointing towards the mortise housing face plate 30.

Pin 113 is a rigid solid cylindrical member extending from first arm 112. Pin 113 extends or protrudes perpendicularly outwards from the second side of trigger lever 110, which is the side of trigger lever 110 facing mortise housing cover plate 40. Thus, the longitudinal axis of pin 113 is perpendicular to the plane of trigger lever 110. Pin 113 has continuous contact with the cam surface 132 of bolt release actuator 130. As bolt release actuator 130 slides or moves, the pin's contact with the cam surface 132 causes trigger lever 110 to rotate.

Second arm 114 is a rigid oblong member or arm protruding radially outward from pivot hole 111. Second arm 114 has a length of about 0.25 to 1 inches. When trigger lever 110 is pivotally attached properly, second arm 114 extends in the direction pointing towards the retracting side of mortise housing base 10.

Catch tab 115 is a rigid tab, protrusion, or catch that extends or protrudes perpendicularly outwards from the second side of trigger lever 110, which is the side of trigger facing the mortise housing cover plate 40. Catch tab 115 functions to catch within trigger lever notch 68 on deadbolt shaft 60 to hold or retain deadbolt shaft 60 in the retracted position.

Trigger lever spring 120 is a torsion spring. Trigger lever spring 120 has a center, a first side arm, and a second arm. The center of trigger lever spring 120 is mounted on trigger lever spring pivot pin 19. The first arm of trigger lever spring 120 extends to contact catch tab 115 on trigger lever 110. The second arm of trigger lever spring 120 extends to contact the inside surface of the retracting side of mortise housing base 10. Trigger lever spring 120 functions to apply constant spring bias or spring pressure to push the second arm 114 or trigger lever 110 upwards.

Bolt release actuator 130 is a rigid solid rectangular cuboid member. Bolt release actuator 130 has a first side, a second side, an upper side, a lower side, an opening side, a retracting side, a longitudinal axis, and a longitudinal bisect. Bolt release actuator 130 has a width slightly less than that of the upper and lower side of mortise housing base 10. Bolt release actuator 130 has a height of about 0.25-1.5 inches. Bolt release actuator 130 has a length of about 1-3 inches. Bolt release actuator 130 is slideably attached to bolt release actuator slot track pin 21 and bolt release actuator mounting pin 22. Bolt release actuator 130 comprises: a cam surface 132; a slot track 134; and a button 136. With bolt release actuator 130 attached properly, the longitudinal axis of bolt release actuator 130 is parallel to the plane of upper and lower side of mortise housing base 10, wherein bolt release actuator 130 slides or moves back and forth along its longitudinal axis.

Cam surface 132 is an angled or slanted surface on the opening side of bolt release actuator 130. Rather than being a perpendicular surface, the opening side of bolt release actuator 130 is a 45 degree angled surface that is angled upwards or faces upwards. Thus, bolt release actuator 130 is not a true rectangular cuboid. Cam surface makes continuous contact with pin 113 on trigger lever 110 as a result of trigger lever spring 120 forcing pin 113 downward to contact the cam surface 132 that is on a 45 degree angle facing upwards.

Slot track 134 is an oblong void, slot, or channel in bolt release actuator 130. Slot track 134 runs completely through bolt release actuator 130 from the first side of bolt release actuator 130 to the second side of bolt release actuator 130. Slot track 134 has a longitudinal axis that runs parallel with that of bolt release actuator 130. Slot track 134 has a width slightly larger than the diameter of bolt release actuator slot track pin 21 that is sized to make a slip fit with bolt release actuator slot track pin 21. Slot track 134 has a length of about 1.5-3 times the diameter of bolt release actuator slot track pin 21. Slot track 134 functions to help slideably attach bolt release actuator 130 to mortise housing base 10. In order to properly attach bolt release actuator 130, the second end of bolt release actuator slot track pin 21 is inserted through the opening of slot track 134 on the first side of bolt release actuator 130 to extend out of the opening of slot track 134 on the second side of bolt release actuator 130.

Button 136 is a rigid solid cylindrical member or square cuboid member. Button 136 has opening end, a retracting end, and a longitudinal axis. Button 136 is located on the opening side of bolt release actuator 130 with its longitudinal axis parallel with that of bolt release actuator 130. The retracting end of button 136 is rigidly attached to the opening end of bolt release actuator 130. The opening end of button 136 protrudes through or extends through button clearance hole 34 on mortise housing face plate 30. Button 136 functions to cause the deadbolt 50 to extend from the retracted position. When deadbolt 50 is in the retracted position, catch tab 115 on trigger lever 110 rests within trigger lever notch 68, which withstands the bias pressure from deadbolt spring 70 to keep deadbolt 50 in the retracted position. When the sliding door is closed, button 136 makes contact with the door jamb (not depicted), which causes bolt release actuator 130 to move or slide towards the retracting side of mortise housing base 10, causing the catch tab 115 to be pushed out of the trigger lever notch 68, and the deadbolt 50 to extend. In order for this to happen, the force or pressure from the closing sliding door must overcome the pressure from the trigger lever spring 120 pushing the second arm 114 upwards. The deadbolt 50 extends when this happens because of the pressure applied by deadbolt spring 70.

Lock block lever 140 is a rigid oblong planar member with a first side, a second side, and a longitudinal axis. Lock block lever 140 is pivotally attached to lock block lever pivot pin 20. Lock block lever 140 comprises: a pivot hole 142; an upper arm 144; and a lower arm 146. Lock block lever 140 rotates from contact with fork arm 88 on T-turn hub 80. Lock block lever 140 functions to transfer rotational motion from T-turn hub 80 to translational motion of lock block 150.

Pivot hole 142 is a circular hole through lock block lever 140. Pivot hole 142 is located in between upper arm 144 and lower arm 146. Pivot hole 142 is pivotally attached to lock block lever pivot pin 20. Pivot hole 142 has a diameter that is sized to make a slip fit with the diameter of lock block lever pivot pin 20.

Upper arm 144 is a rigid oblong member or arm protruding radially outward from pivot hole 142. Upper arm 144 has a length of about 0.5 to 2 inches. Upper arm 144 has a radial end that engages with fork arm 88 on T-turn hub 80. When lock block lever 140 is pivotally attached properly, the radial end of upper arm 144 nests within and rides between the two tines of fork arm 88 as depicted. As T-turn hub 80 is rotated, lock block lever 140 is rotated.

Lower arm 146 is a rigid oblong member or arm protruding radially outward from pivot hole 142. Lower arm 146 has a length of about 0.5 to 2 inches. Lower arm 146 "dog legs" or bends toward the lower side of mortise housing base 10 as depicted. Lower arm 146 has a radial end that nests within and rides within lock block lever pocket 157 on lock block 150. When lock block lever 140 is pivotally attached properly, the radial end of lower arm 146 extends in the direction pointing towards the lower side of mortise housing base 10.

Lock block 150 is a rigid solid rectangular cuboid member. Lock block 150 has a first side, a second side, an upper side, a lower side, an opening side, a retracting side, a longitudinal axis, and a longitudinal bisect. Lock block 150 has a width slightly less than that of the upper and lower side of mortise housing base 10. Lock block 150 has a height of about 0.25-1.5 inches. Lock block 150 has a length of about 1-3 inches. Lock block 150 is slideably attached to the first side of mortise housing base 10 and the mortise housing cover plate 40. Lock block 150 comprises: a first tab 151; a second tab 154; a lock block lever pocket 157; a first heel 158; a second heel 159; and a spring ridge 160. With lock block 150 attached properly, the longitudinal axis of Lock block 150 is parallel to the plane of upper and lower side of mortise housing base 10, wherein bolt release actuator 130 slides or moves back and forth along its longitudinal axis. Lock block 150 functions to lock and unlock auto-latching/locking mortise lock for sliding door 2. Lock block 150 can slide into a "locked" position, which locks auto-latching/locking mortise lock for sliding door 2, and slide into an "unlocked" position, which unlocks auto-latching/locking mortise lock for sliding door 2. In best mode, lock block 150, first tab 151, second tab 154, lock block lever pocket 157, first heel 158, second heel 159; and spring ridge 160 are molded, carved, or machined from one solid piece of material.

First tab 151 is a rigid solid rectangular cuboid shaped or square cuboid shaped member on the first side of lock block 150 that protrudes from the corner or intersection of the first side and the retracting side of lock block 150 as depicted. First tab 151 is a rigid tab that slides within or rides within retracting side lock block slot track 25. First tab 151 has a first side, a second side, an upper side, a lower side, an opening side, a retracting side, and a longitudinal axis. The corner or intersection of the upper side and the opening side of first tab 151 is rigidly attached to, connected to, or integral to the corner or intersection of the first side and the retracting side of lock block 150. The upper and lower sides of first tab 151 are parallel and flush with those of the lock block 150. The first and second sides of first tab 151 are parallel with those of lock block 150. The longitudinal axis of first tab 151 is parallel with that of lock block 150 and retracting side lock block slot track 25. The width of first tab 151 is slightly smaller than that of retracting side lock block slot track 25 so that first tab 151 may freely slide within retracting side lock block slot track 25. The length of first tab 151 must be less than that of retracting side lock block slot track 25 so that lock block 150 may slide back and forth therein. With lock block 150 properly installed within auto-latching/locking mortise lock for sliding door 2, the first side of first tab 151 is flush with the outside surface of the first side of mortise housing base 10.

First tab 151 may optionally have a pin hole 152 or a screw hole 153. Pin hole 152 is a cylindrical hole running through first tab 151 from the upper side to the lower side. Pin hole 152 has an inner diameter and a longitudinal axis. The longitudinal axis of pin hole 152 is parallel with the first and second sides of lock block 150. Pin hole 152 functions to optionally receive a lock block pin 161 as described below. Screw hole 153 is a cylindrical tapped hole running through first tab 151 from the upper side to the lower side. Screw hole 153 has an inner diameter and a longitudinal axis. Screw hole 153 has female thread along its inner diameter. The longitudinal axis of screw hole 153 is parallel with the first and second sides of lock block 150. Screw hole 153 functions to optionally receive a lock block screw 162 as described below. The interchangeable system of auto-latching/locking mortise lock for sliding door 2 is partially provided by the options of whether to include: pin hole 152, lock block pin 161, screw hole 153, or lock block screw 162.

Second tab 154 is a rigid solid rectangular cuboid shaped or square cuboid shaped member on the first side of lock block 150 that protrudes from the corner or intersection of the second side and the retracting side of lock block 150 as depicted. Second tab 154 is a rigid tab that slides within or rides within retracting side lock block slot track 45. Second tab 154 has a first side, a second side, an upper side, a lower side, an opening side, a retracting side, and a longitudinal axis. The corner or intersection of the lower side and the opening side of second tab 154 is rigidly attached to, connected to or integral to the corner or intersection of the second side and the retracting side of lock block 150. The upper and lower sides of second tab 154 are parallel and flush with those of lock block 150. The first and second sides of second tab 154 are parallel with those of the lock block 150. The longitudinal axis of second tab 154 is parallel with that of lock block 150 and retracting side lock block slot track 45. The width of second tab 154 is slightly smaller than that of retracting side lock block slot track 45 so that second tab 154 may freely slide within retracting side lock block slot track 45. The length of second tab 154 must be less than that of retracting side lock block slot track 45 so that lock block 150 may slide back and forth therein. With lock block 150 properly installed within auto-latching/locking mortise lock for sliding door 2, the second side of second tab 154 is flush with the outside side of the mortise housing cover plate 40.

Second tab 154 may optionally have a pin hole 155 or a screw hole 156. Pin hole 155 is a cylindrical hole running through second tab 154 from the upper side to the lower side. Pin hole 155 has an inner diameter and a longitudinal axis. The longitudinal axis of pin hole 155 is parallel with the first and second sides of lock block 150. Pin hole 155 functions to optionally receive a lock block pin 161 as described below. Screw hole 156 is a cylindrical tapped hole running through second tab 154 from the upper side to the lower side. Screw hole 156 has an inner diameter and a longitudinal axis. Screw hole 156 has female thread along its inner diameter. The longitudinal axis of screw hole 156 is parallel with the first and second sides of lock block 150. Screw hole 156 functions to optionally receive a lock block screw 162 as described below. The interchangeable system of auto-latching/locking mortise lock for sliding door 2 is partially provided by the options of whether to include: pin hole 155, lock block pin 161, screw hole 156, or lock block screw 162.

Lock block lever pocket 157 is a void or hole in lock block 150. Lock block lever pocket 157 is rectangular cuboid or square cuboid shaped notch or void taken out of the upper side of lock block 150, in between the second tab 154 and the second heel 159. Lock block lever pocket 157 does not break through the first side of lock block 150. Lock block lever pocket 157 functions to receive and hold within it, the radial end of the lower arm 106 of bolt retraction lever 100, as depicted. The radial end of the lower arm 106 of bolt retraction lever 100 rides within lock block lever pocket 157 to cause the lock block 150 to slide or move back and forth horizontally as the bolt retraction lever 100 is rotated. When T-turn hub 80 is rotated one way, this causes the fork arm 88 to rotate away from the retracting side of mortise housing base 10, which causes the lower arm 106 of bolt retraction lever 100 to rotate towards the retracting side of mortise housing base 10, which causes the lock block 150 to slide towards the retracting side of mortise housing base 10. As discussed below, this locks auto-latching/locking mortise lock for sliding door 2. When T-turn hub 80 is rotated the other, this causes the fork arm 88 to rotate away from the mortise housing face plate 30, which causes the lower arm 106 of bolt retraction lever 100 to rotate towards the mortise housing face plate 30, which causes the lock block 150 to slide towards the mortise housing face plate 30. As discussed below, this unlocks auto-latching/locking mortise lock for sliding door 2.

First heel 158 is a rigid solid rectangular cuboid shaped or square cuboid shaped member on the first side of lock block 150 that protrudes from the first side of lock block 150 as depicted. First heel 158 is a rigid tab that slides within or rides within opening side lock block slot track 26. First heel 158 has a first side, a second side, an upper side, a lower side, an opening side, a retracting side, and a longitudinal axis. The second side of first heel 158 is rigidly attached to, connected to, or integral to the first side of lock block 150, adjacent to the opening side of lock block 150. The upper and lower sides of first heel 158 are parallel and flush with those of the lock block 150. The first side of first heel 158 is parallel with that of lock block 150. The opening side of first heel 158 is parallel and flush with that of lock block 150. The longitudinal axis of first heel 158 is parallel with that of lock block 150 and opening side lock block slot track 26. The width of first heel 158 is slightly smaller than that of opening side lock block slot track 26 so that first heel 158 may freely slide within opening side lock block slot track 26. The length of first heel 158 must be less than that of opening side lock block slot track 26 so that lock block 150 may slide back and forth therein. With lock block 150 properly installed within auto-latching/locking mortise lock for sliding door 2, the first side of first heel 158 is flush with the outside surface of the first side of mortise housing base 10.

Second heel 159 is a rigid solid rectangular cuboid shaped or square cuboid shaped member on the second side of lock block 150 that protrudes from the second side of lock block 150 as depicted. Second heel 159 is a rigid tab that slides within or rides within opening side lock block slot track 46. Second heel 159 has a first side, a second side, an upper side, a lower side, an opening side, a retracting side, and a longitudinal axis. The first side of second heel 159 is rigidly attached to, connected to, or integral to the second side of lock block 150, adjacent to the opening side of lock block 150. The upper and lower sides of second heel 159 are parallel and flush with those of the lock block 150. The second side of second heel 159 is parallel with that of lock block 150. The opening side of second heel 159 is parallel and flush with that of lock block 150. The longitudinal axis of second heel 159 is parallel with that of lock block 150 and opening side lock block slot track 46. The width of second heel 159 is slightly smaller than that of opening side lock block slot track 46 so that second heel 159 may freely slide within opening side lock block slot track 46. The length of second heel 159 must be less than that of opening side lock block slot track 46 so that lock block 150 may slide back and forth therein. With lock block 150 properly installed within auto-latching/locking mortise lock for sliding door 2, the second side of second heel 159 is flush with the outside surface of mortise housing face plate 30.

Spring ridge 160 is a rigid oblong protrusion or rib extending outward from the first side of lock block 150. Spring ridge 160 has a width, a length, a height, and a longitudinal axis. The height of spring ridge 160 is about 0.0625 to 0.25 inches. The longitudinal axis of spring ridge 160 is parallel with the opening and retracting sides of lock block 150 and perpendicular to the first and second sides of lock block 150. Spring ridge 160 is located in between tabs 151,154 and heels 158,159. Spring ridge 160 engages with the second arm of lock block spring 170. This engagement functions to force or push lock block 150 in either the locked position or the unlocked position.

Lock block pin 161 is a solid rigid horizontal cylindrical member with a diameter, a length, a first end, a second end, and a longitudinal axis. The diameter of lock block pin 161 is sized to make a press fit with pin holes 152,155. Lock block 150 may optionally include a lock block pin 161 pressed in pin hole 152. Lock block 150 may optionally include a lock block pin 161 pressed in pin hole 155.

Lock block screw 162 is a screw, bolt, fastener, clip, or similar. Lock block screw 162 has a first end, a second end, and a longitudinal axis. The first end of Lock block screw 162 has male thread that is sized to engage with the female thread on screw holes 153,156. The second end of lock block screw 162 has a head that engages with a tool such as a driver, wrench, socket, bit, or similar. Lock block 150 may optionally include a lock block screw 162 threaded into screw hole 153. Lock block 150 may optionally include a lock block screw 162 threaded into screw hole 156.

Lock block spring 170 is a torsion spring. Lock block spring 170 has a center, a first side arm, and a second arm. The center of lock block spring 170 is mounted on lock block spring pivot support pillar 28. The first arm of lock block spring 170 extends to contact the first side of lock block 150. The second arm of lock block spring 170 extends to contact the inside surface of the lower side of mortise housing base 10. The first arm of lock block spring 170 engages with spring ridge 160, which pushes the lock block 150 towards the retracting side/locked position or the opening side/unlocked position. As the lock block 150 passes between these positions, the first arm of lock block spring 170 passes over the peak of spring ridge 160 and down the side of spring ridge 160 to hold lock block into a position on either side of spring ridge 160. Lock block 150 will not hold with the first arm of lock block spring 170 contacting the peak of spring ridge 160 and slides down the peak of spring ridge 160 to push and hold lock block 150 to one side or the other of spring ridge 160.

First lever hub 180 is a hub or center of a wheel or rotating member. First lever hub 180 is a rigid member. First lever hub 180 has a first side and a second side. First lever hub 180 comprises: a socket 182; a key tab 183; a bolt retraction arm 184; and a lock block arm 186. Lock block arm 186 may further comprise: a V-shaped notch 187 or a U-shaped notch 188. There are three versions or modes of first lever hub 180: one without any notch, one with V-shaped notch 187, and one with a U-shaped notch 188. Socket 182 is a hole through the center of first lever hub 180. Key tab 183 is a rigid protrusion or tab that extends radially outward from socket 182. Lock block arm 186 is a rigid oblong member or arm protruding outward from socket 182. Lock block arm 186 may have a V-shaped notch 187 or a U-shaped notch 188 on its radial end. The first side of first lever hub 180 is pivotally attached to lever hub mounting hole 23 on the first side of mortise housing base 10. The second side of first lever hub 180 is pivotally attached to the first side of second lever hub 190. First lever hub 180 functions to transfer rotational motion from the door knob (not depicted) or door lever (not depicted) to rotational motion on bolt retraction lever 100.

Socket 182 is a rigid cylindrical hole through first lever hub 180. Socket 182 has open ends. Socket 182 runs thorough the center of first lever hub 180. Socket 182 has a first end, a second end, an inner diameter, an inner surface, an outer diameter, an outer surface, and a longitudinal axis. First lever hub 180 is pivotally attached to the first side of mortise housing base 10 at the lever hub mounting hole 23 so that the longitudinal axis of socket 182 is perpendicular to the planes of first side of mortise housing base 10 and mortise housing cover plate 40. The outer diameter of socket 182 is sized to make a slip fit with the diameter of lever hub mounting hole 23. The outer surface of socket 182 is smooth. The inner surface of socket 182 has a plurality of points or ridges that function to engage with a square spindle or shaft from a door knob (not depicted) or door lever (not depicted). A spindle or shaft from a door knob or door lever is inserted and installed through socket 182 to form a connection therewith so that first lever hub 180 rotates along with the spindle or shaft from the a door knob or door lever. A door knob or door lever is not an element of auto-latching/locking mortise lock for sliding door 2 but is included with a mortise lock set.

Key tab 183 on first lever hub 180 is a rigid tab, protrusion, or catch that extends or protrudes radially outward from the outer diameter of socket 182. Key tab 183 nests within key notch 24 on the first side of mortise housing base 10 to pivotally attach or slideably attach therein. Key tab 183 has a width. Key tab 183 has an opening side and a retracting side. The width of key notch 24 must be larger than that of key tab 183 so that key tab 183 may slide back and forth or rotate back and forth within key notch 24. Key tab 183 functions to contact or catch on key notch 24 and thereby limit the rotation of first lever hub 180 within lever hub mounting hole 23. When first lever hub 180 is rotated one way, the opening side of key tab 183 contacts the opening end of key notch 24 to prevent any more rotation of first lever hub 180 beyond this contact. When first lever hub 180 rotates the other way, the retracting side of key tab 183 contacts the retracting end of key notch 24 to prevent any more rotation of first lever hub 180 beyond this contact.

Bolt retraction arm 184 is a rigid oblong member or arm protruding radially outward from the exterior surface of socket 182. When first lever hub 180 is pivotally attached properly, bolt retraction arm 184 extends in the direction pointing upwards towards the upper side of mortise housing base 10. Bolt retraction arm 184 has an overall length of about 0.125 to 1 inches. Bolt retraction arm 184 functions to contact pin 113 on trigger lever 110 in order to retract deadbolt 50 to open the sliding door. Bolt retraction arm 184 is rotated toward mortise housing face plate 30 to contact pin 113 on first arm 112 of trigger lever 110 to rotate it towards the mortise housing face plate 30 so the second arm 114 of trigger lever 110 rotates towards the retracting side of mortise housing base 10 to contact the head 96 on pendulum arm 94 of bolt retraction hub 90 and rotate head 96 towards the retracting side of mortise housing base 10 to contact the pendulum arm pocket 64 in deadbolt shaft 60 to slide deadbolt shaft 60 towards the retracting side of mortise housing base 10 to overcome the deadbolt spring 70 pressure and retract deadbolt 50 so that the catch tab 115 on trigger lever 110 falls within trigger lever notch 68 on deadbolt shaft 60 to hold deadbolt 50 in the retracted position.

Lock block arm 186 is a rigid oblong member or arm protruding outward from the exterior surface of socket 182. When first lever hub 180 is pivotally attached properly, lock block arm 186 extends in the direction pointing towards the mortise housing face plate 30. Lock block arm 186 has an overall length of about 0.125 to 1 inches. Lock block arm 186 functions to contact lock block 150 in order to unlock auto-latching/locking mortise lock for sliding door 2. Lock block arm 186 is rotated downwards toward the lower side of mortise housing base 10 to contact lock block 150. With a V-shaped notch 187, lock block arm 186 slides lock block 150 towards the mortise housing face plate 30 to overcome the lock block spring 170 pressure and unlock auto-latching/locking mortise lock for sliding door 2. With a U-shaped notch 188, lock block arm 186 will not slide the lock block 150 and auto-latching/locking mortise lock for sliding door 2 remains locked. If auto-latching/locking mortise lock for sliding door 2 is already unblocked, lock block arm 186 does not contact lock block 150 when rotated.

V-shaped notch 187 is a V-shaped notch or void in the radial end of lock block arm 186. When first lever hub 180 is pivotally attached properly, V-shaped notch 187 extends in the direction pointing towards mortise housing face plate 30. V-shaped notch 187 has an overall length of about 0.125 to 1 inches. The open part of the V-shape faces the mortise housing face plate 30. The V-shaped notch 187 functions to contact an optional lock block pin 161 or an optional lock block screw 162 when first lever hub 180 is rotated to cause the lock block 150 to overcome pressure from the lock block spring 170 and slide towards the mortise housing face plate 30 to unlock auto-latching/locking mortise lock for sliding door 2. The optional lock block pin 161 or optional lock block screw 162 nests within and rides within the V-shaped notch 187 when lock block 150 is in the locked position. The V-shaped notch 187 allows the optional lock block pin 161 or optional lock block screw 162 to slide along the angle of the V and to slide or move the lock block 150 out of the locked position. The V-shaped notch 187 allows the optional lock block pin 161 or optional lock block screw 162 to slide therein while the U-shaped notch does not allow the optional lock block pin 161 or optional lock block screw 162 to slide. The V-shaped notch 187 is the automatic unlocking mechanism. This mechanism is an automatic unlocking mechanism that automatically unlocks auto-latching/locking mortise lock for sliding door 2 when first lever hub 180 is rotated by the door knob or door handle. If the optional lock block pin 161 or optional lock block screw 162 is not included, then the automatic unlocking mechanism does not function. V-shaped notch 187 is an optional part of the automatic unlocking system. The interchangeable system of auto-latching/locking mortise lock for sliding door 2 is partially provided by the options of whether to include: V-shaped notch 187 or U-shaped notch 188.

U-shaped notch 188 is a U-shaped notch or void in the radial end of lock block arm 186. When first lever hub 180 is pivotally attached properly, U-shaped notch 188 extends in the direction pointing towards mortise housing face plate 30. U-shaped notch 188 has an overall length of about 0.125 to 1 inches. The open part of the U-shape faces the mortise housing face plate 30. The U-shaped notch 188 functions to contact an optional lock block pin 161 or an optional lock block screw 162 when first lever hub 180 is rotated, which stops the rotation of first lever hub 180 and prevents the retraction of deadbolt 50 and thereby keeps auto-latching/locking mortise lock for sliding door 2 locked. The optional lock block pin 161 or optional lock block screw 162 nests within and rides within the U-shaped notch 188 when lock block 150 is in the locked position. The U-shaped notch does not allow the optional lock block pin 161 or optional lock block screw 162 to slide along the straight portion of the U to keep lock block 150 in the locked position. This U-shaped notch does not allow automatic unlocking. If the optional lock block pin 161 or optional lock block screw 162 is not included, then the automatic unlocking mechanism still does not function. U-shaped notch 188 is an optional part of the automatic unlocking system. The interchangeable system of auto-latching/locking mortise lock for sliding door 2 is partially provided by the options of whether to include: V-shaped notch 187 or U-shaped notch 188.

Second lever hub 190 is a hub or center of a wheel or rotating member. Second lever hub 190 is a rigid member. Second lever hub 190 has a first side and a second side. Second lever hub 190 comprises: a socket 192; a key tab 193; a bolt retraction arm 194; and a lock block arm 196. Lock block arm 196 may further comprise: a V-shaped notch 197 or a U-shaped notch 198. There are three versions or modes of second lever hub 190: one without any notch, one with V-shaped notch 197, and one with a U-shaped notch 198. Socket 192 is a hole through the center of second lever hub 190. Key tab 193 is rigid protrusion or tab that extends radially outward from socket 192. Bolt retraction arm 194, V-shaped notch 197, and lock block arm with a U-shaped Notch 198 are each rigid protrusions or arms that extends radially outward from socket 192. The second side of second lever hub 190 is pivotally attached to lever hub mounting hole 43 on mortise housing cover plate 40. The second side of first lever hub 180 is pivotally attached to the first side of second lever hub 190. Second lever hub 190 functions to transfer rotational motion from the door knob (not depicted) or door lever (not depicted) to rotational motion on bolt retraction lever 100.

Socket 192 is a rigid cylindrical hole through second lever hub 190. Socket 192 has open ends. Socket 192 runs thorough the center of second lever hub 190. Socket 192 has a first end, a second end, an inner diameter, an inner surface, an outer diameter, an outer surface, and a longitudinal axis. Second lever hub 190 is pivotally attached to the mortise housing cover plate 40 at the lever hub mounting hole 43 so that the longitudinal axis of socket 192 is perpendicular to the planes of first side of mortise housing base 10 and mortise housing cover plate 40. The longitudinal axes of first and second lever hubs 180,190 are concentric. The outer diameter of socket 192 is sized to make a slip fit with the diameter of lever hub mounting hole 43. The outer surface of socket 192 is smooth. The inner surface of socket 192 has a plurality of points or ridges that function to engage with a square spindle or shaft from a door knob (not depicted) or door lever (not depicted). A spindle or shaft from a door knob or door lever is inserted and installed through socket 192 to form a connection therewith so that second lever hub 190 rotates along with the spindle or shaft from the a door knob or door lever. A door knob or door lever is not an element of auto-latching/locking mortise lock for sliding door 2 but is included with a mortise lock set. The spindle inserted into second lever hub 190 is not connected to and separate from the spindle inserted in the second lever hub 190, so that the first and second lever hubs 180,190 may rotate independently from one another.

Key tab 193 on second lever hub 190 is a rigid tab, protrusion, or catch that extends or protrudes radially outward from the outer diameter of socket 192. Key tab 193 nests within key notch 44 on mortise housing cover plate 40 to pivotally attach or slideably attach therein. Key tab 193 has a width. Key tab 193 has an opening side and a retracting side. The width of key notch 44 must be larger than that of key tab 193 so that key tab 193 may slide back and forth or rotate back and forth within key notch 44. Key tab 193 functions to contact or catch on key notch 44 and thereby limit the rotation of second lever hub 190 within lever hub mounting hole 43. When second lever hub 190 is rotated one way, the opening side of key tab 193 contacts the opening end of key notch 44 to prevent any more rotation of second lever hub 190 beyond this contact. When second lever hub 190 rotates the other way, the retracting side of key tab 193 contacts the retracting end of key notch 44 to prevent any more rotation of second lever hub 190 beyond this contact.

Bolt retraction arm 194 is a rigid oblong member or arm protruding radially outward from the exterior surface of socket 192. When second lever hub 190 is pivotally attached properly, bolt retraction arm 194 extends in the direction pointing upwards towards the upper side of mortise housing base 10. Bolt retraction arm 194 has an overall length of about 0.125 to 1 inches. Bolt retraction arm 194 functions to contact pin 113 on trigger lever 110 in order to retract deadbolt 50 to open the sliding door. Bolt retraction arm 194 is rotated toward mortise housing face plate 30 to contact pin 113 on first arm 112 of trigger lever 110 to rotate it towards the mortise housing face plate 30 so the second arm 114 of trigger lever 110 rotates towards the retracting side of mortise housing base 10 to contact the head 96 on pendulum arm 94 of bolt retraction hub 90 and rotate head 96 towards the retracting side of mortise housing base 10 to contact the pendulum arm pocket 64 in deadbolt shaft 60 to slide deadbolt shaft 60 towards the retracting side of mortise housing base 10 to overcome the deadbolt spring 70 pressure and retract deadbolt 50 so that the catch tab 115 on trigger lever 110 falls within trigger lever notch 68 on deadbolt shaft 60 to hold deadbolt 50 in the retracted position.

Lock block arm 196 is a rigid oblong member or arm protruding outward from the exterior surface of socket 192. When second lever hub 190 is pivotally attached properly, lock block arm 196 extends in the direction pointing towards the mortise housing face plate 30. Lock block arm 196 has an overall length of about 0.125 to 1 inches. Lock block arm 196 functions to contact lock block 150 in order to unlock auto-latching/locking mortise lock for sliding door 2. Lock block arm 196 is rotated downwards toward the lower side of mortise housing base 10 to contact lock block 150. With a V-shaped notch 197, lock block arm 196 slides lock block 150 towards the mortise housing face plate 30 to overcome the lock block spring 170 pressure and unlock auto-latching/locking mortise lock for sliding door 2. With a U-shaped notch 198, lock block arm 196 will not slide the lock block 150 and auto-latching/locking mortise lock for sliding door 2 remains locked. If auto-latching/locking mortise lock for sliding door 2 is already unblocked, lock block arm 196 does not contact lock block 150 when rotated.

V-shaped notch 197 is a V-shaped notch or void in the radial end of lock block arm 196. When second lever hub 190 is pivotally attached properly, V-shaped notch 197 extends in the direction pointing towards mortise housing face plate 30. V-shaped notch 197 has an overall length of about 0.125 to 1 inches. The open part of the V-shape faces the mortise housing face plate 30. The V-shaped notch 197 functions to contact an optional lock block pin 161 or an optional lock block screw 162 when second lever hub 190 is rotated to cause the lock block 150 to overcome pressure from the lock block spring 170 and slide towards the mortise housing face plate 30 to unlock auto-latching/locking mortise lock for sliding door 2. The optional lock block pin 161 or optional lock block screw 162 nests within and rides within the V-shaped notch 197 when lock block 150 is in the locked position. The V-shaped notch 197 allows the optional lock block pin 161 or optional lock block screw 162 to slide along the angle of the V to slide or move the lock block 150 out of the locked position. This mechanism is an automatic unlocking mechanism that automatically unlocks auto-latching/locking mortise lock for sliding door 2 when second lever hub 190 is rotated by the door knob or door handle. If the optional lock block pin 161 or optional lock block screw 162 is not included, then the automatic unlocking mechanism does not function. V-shaped notch 197 is an optional part of the automatic unlocking system. The interchangeable system of auto-latching/locking mortise lock for sliding door 2 is partially provided by the options of whether to include: V-shaped notch 197 or U-shaped notch 198.

U-shaped notch 198 is a U-shaped notch or void in the radial end of lock block arm 186. When second lever hub 190 is pivotally attached properly, U-shaped notch 198 extends in the direction pointing towards mortise housing face plate 30. U-shaped notch 198 has an overall length of about 0.125 to 1 inches. There is a U-shaped notch or void on the radial end of U-shaped notch 198. The open part of the U-shape faces the mortise housing face plate 30. The U-shaped notch or void functions to contact an optional lock block pin 161 or an optional lock block screw 162 when second lever hub 190 is rotated, which stops the rotation of second lever hub 190 and prevents the retraction of deadbolt 50 and thereby keeps auto-latching/locking mortise lock for sliding door 2 locked. The optional lock block pin 161 or optional lock block screw 162 nests within and rides within the U-shaped notch when lock block 150 is in the locked position. The U-shaped notch does not allow the optional lock block pin 161 or optional lock block screw 162 to slide along the straight portion of the U to keep lock block 150 in of the locked position. This U-shaped notch does not allow automatic unlocking. If the optional lock block pin 161 or optional lock block screw 162 is not included, then the automatic unlocking mechanism still does not function. U-shaped notch 198 is an optional part of the automatic unlocking system. The interchangeable system of auto-latching/locking mortise lock for sliding door 2 is partially provided by the options of whether to include: V-shaped notch 197 or U-shaped notch 198. Lever hub spring 200 is a torsion spring. Lever hub spring 200 has a center, a first side arm, and a second arm. The center of lever hub spring 200 is mounted on lever hub spring pivot support pillar 27. The first arm of lever hub spring 200 extends to contact lock block arms 186,196. The second arm of lever hub spring 200 extends to contact the inside surface of the lower side of mortise housing base 10. Lever hub spring 200 functions to apply constant spring bias or spring pressure to push lock block arms 186,196 upwards. Lever hub spring 200 contacts and applies pressure to rotate both lock block arms 186,196 upwards. This spring pressure forces key tabs 183,193 against the retracting sides of key notches 24,44 respectively to keep the first and second lever hubs 180,190 and their connect door knobs or levers in this home position. Thus, after a door knob or lever is turned, it springs back to this biased home position with key tabs 183,193 resting against the retracting sides of key notches 24,44 respectively.

When the sliding door is closed, deadbolt 50 is in the extended position to latch the sliding door shut. In order to open the sliding door, the deadbolt 50 must be retracted. To retract deadbolt 50, a door knob or lever is turned to rotate first or second lever hub 180,190, which rotates bolt retraction lever 100, which rotates bolt retraction hub 90, which slides deadbolt shaft 60, which retracts deadbolt 50. With the deadbolt 50 retracted, sliding door may be opened. Deadbolt automatically extends when sliding door is closed. When the sliding door is closed, button 136 makes contact with the door jamb, which causes bolt release actuator 130 to move or slide towards the retracting side of mortise housing base 10, causing the catch tab 115 to be pushed out of the trigger lever notch 68, and the deadbolt 50 to extend from bias pressure applied by the deadbolt spring 70.

For an ANSI or BHMA passage door lock: lock block 150 does not have any lock block pins 161 or any lock block screws 162 installed; first lever hub 180 has a V-shaped notch 187; and second lever hub 190 has a V-shaped notch 197.

For an ANSI or BHMA privacy door lock: lock block 150 has a lock block pin 161 installed in pin holes 152,155; first lever hub 180 has a V-shaped notch 187 if oriented toward the inside of the room or a U-shaped notch 188 if oriented toward the outside of the room; and second lever hub 190 has a V-shaped notch 197 if oriented toward the inside of the room or a U-shaped notch 198 if oriented toward the outside of the room.

For an ANSI or BHMA office door lock: lock block 150 has a lock block pin 161 installed in pin holes 152,155; first lever hub 180 has a V-shaped notch 187 if oriented toward the inside of the room or a U-shaped notch 188 if oriented toward the outside of the room; and second lever hub 190 has a V-shaped notch 197 if oriented toward the inside of the room or a U-shaped notch 198 if oriented toward the outside of the room.

For an ANSI or BHMA entry door lock: screw hole 153 does not have a lock block screw 162 installed if oriented toward the inside of the room and does have lock block screw 162 installed if oriented toward the outside of the room; screw hole 156 does not have a lock block screw 162 installed if oriented toward the inside of the room and does have lock block screw 162 installed if oriented toward the outside of the room; first lever hub 180 has a U-shaped notch 188; and second lever hub 190 has a U-shaped notch 198.

For an ANSI or BHMA communication/patio door lock: screw hole 153 does not have a lock block screw 162 installed if oriented toward the inside of the room and does have lock block screw 162 installed if oriented toward the outside of the room; screw hole 156 does not have a lock block screw 162 installed if oriented toward the inside of the room and does have lock block screw 162 installed if oriented toward the outside of the room; first lever hub 180 has a U-shaped notch 188; and second lever hub 190 has a U-shaped notch 198.

For an ANSI or BHMA classroom door lock: screw hole 153 does not have a lock block screw 162 installed if oriented toward the inside of the room and does have lock block screw 162 installed if oriented toward the outside of the room; screw hole 156 does not have a lock block screw 162 installed if oriented toward the inside of the room and does have lock block screw 162 installed if oriented toward the outside of the room; first lever hub 180 has a U-shaped notch 188; and second lever hub 190 has a U-shaped notch 198.

For an ANSI or BHMA storeroom door lock: screw hole 153 does not have a lock block screw 162 installed if oriented toward the inside of the room and does have lock block screw 162 installed if oriented toward the outside of the room; screw hole 156 does not have a lock block screw 162 installed if oriented toward the inside of the room and does have lock block screw 162 installed if oriented toward the outside of the room; first lever hub 180 has a U-shaped notch 188; and second lever hub 190 has a U-shaped notch 198.

What is claimed is:

1. A mortise lock comprising: a mortise housing base [10]; a mortise housing face plate [30]; a mortise housing cover plate [40]; a deadbolt [50]; a deadbolt shaft [60]; a deadbolt spring [70]; a T-turn hub [80]; a bolt retraction hub [90]; a bolt retraction lever [100]; a trigger lever [110]; a trigger lever spring [120]; a bolt release actuator [130]; a lock block lever [140]; a lock block [150]; a lock block spring [170]; a first lever hub [180]; a second lever hub [190]; and a lever hub spring [200], wherein, said mortise housing base [10] comprises a first side, an upper side, a lower side, and a retracting side, said mortise housing face plate [30] comprises an inside surface, an outside surface, a first edge, a second edge, an upper edge, and a lower edge, said mortise housing cover plate [40] comprises an outside surface, an upper edge, a lower edge, an opening edge, and a retracting edge, said deadbolt [50] is a rigid rectangular cuboid shaped member that comprises an upper deadbolt wing [51], an upper deadbolt wing pivot pin [52], an upper deadbolt wing latch protrusion [53], an upper deadbolt wing heel protrusion [54], a deadbolt wing spring [55], a lower deadbolt wing [56], a lower deadbolt wing pivot pin [57], a lower deadbolt wing latch protrusion [58], and a lower deadbolt wing heel protrusion [59], said deadbolt shaft [60] is a rigid oblong planar member with a first side, a second side, an upper edge, a lower edge, an opening edge, a retracting edge, and a longitudinal axis that comprises a deadbolt attachment arm [62], a pendulum arm pocket [64], a tab [66], and a trigger lever notch [68], said deadbolt spring [70] is a torsion spring with a center, a first side arm, and a second arm, said T-turn hub [80] is a hub or center of a wheel or rotating member that comprises a socket [82], a first lock cylinder catch arm [84], a second lock cylinder catch arm [86], and a fork arm [88], said bolt retraction hub [90] is a hub or center of a wheel or rotating member that comprises a socket [92] and a pendulum arm [94], said bolt retraction lever [100] is a rigid oblong planar member with a first side, a second side, and a longitudinal axis that comprises a pivot hole [102], an upper arm [104], a lower arm [106], and a pin [108], said trigger lever [110] is a rigid oblong planar member with a first side, a second side, and a longitudinal axis that comprises a pivot hole [111], a first arm [112], a pin [113], a second arm [114], and a catch tab [115], said trigger lever spring [120] is a torsion spring with a center, a first side arm, and a second arm, said bolt release actuator [130] is a rigid solid rectangular cuboid member that comprises a cam surface [132], a slot track [134], and a button [136], said lock block lever [140] is a rigid oblong planar member with a first side, a second side, and a longitudinal axis that comprises a pivot hole [142], an upper arm [144], and a lower arm [146], said lock block [150] is a rigid solid rectangular cuboid member that comprises a first tab [151], a second tab [154], a lock block lever pocket [157], a first heel [158], a second heel [159], and a spring ridge [160], said lock block spring [170] is a torsion spring a center, a first side arm, and a second arm, said first lever hub [180] is a hub or center of a wheel or rotating member comprising a socket [182], a key tab [183], a bolt retraction arm [184], and a lock block arm [186], said second lever hub [190] is a hub or center of a wheel or rotating member comprising a socket [192], a key tab [193], a bolt retraction arm [194], and a lock block arm [196], said lever hub spring [200] is a torsion spring with a center, a first side arm, and a second arm, said mortise housing face plate [30] is reversibly attachable to said mortise housing base [10], said mortise housing cover plate [40] is reversibly attachable to said mortise housing base [10], said deadbolt [50] is rigidly attached to said deadbolt attachment arm [62], said deadbolt [50] and said deadbolt shaft [60] are slideably attached to said mortise housing base [10] and said mortise housing face plate [30], said upper deadbolt wing [51] is pivotally attached to said deadbolt [50] with said upper deadbolt wing pivot pin [52], said lower deadbolt wing [56] is pivotally attached to said deadbolt [50] with said lower deadbolt wing pivot pin [57], said deadbolt wing spring [55] is a compression spring with an upper end attached to said upper deadbolt wing heel protrusion [54] and a lower end attached to said lower deadbolt wing heel protrusion [59], said deadbolt spring [70] is pivotally attached to said mortise housing base [10], said T-turn hub [80] is pivotally attached to said mortise housing base [10] and said mortise housing cover plate [40], said bolt retraction hub [90] is pivotally attached to said mortise housing base [10], said bolt retraction lever [100] is pivotally attached to said mortise housing base [10], said trigger lever [110] is pivotally attached to said mortise housing base [10], said trigger lever spring [120] is pivotally attached to said mortise housing base [10], said bolt release actuator [130] is slideably attached to said mortise housing base [10] and said mortise housing face plate [30], said lock block lever [140] is pivotally attached to said mortise housing base [10], said lock block [150] is to said mortise housing base [10] and said mortise housing cover plate [40], said lock block spring [170] is pivotally attached to said mortise housing base [10], said first lever hub [180] is pivotally attached to said mortise housing base [10], said second lever hub [190] is pivotally attached to said mortise housing cover plate [40], and said lever hub spring [200] is pivotally attached to said mortise housing base [10].

2. A mortise lock as recited in claim 1 wherein said first tab [151] on said lock block [150] further comprises a pin hole [152].

3. A mortise lock as recited in claim 2 wherein said bolt retraction arm on said first lever hub [180] further comprises a V-shaped notch [187].

4. A mortise lock as recited in claim 2 wherein said bolt retraction arm on said first lever hub [180] further comprises a U-shaped notch [188].

5. A mortise lock as recited in claim 2 wherein said bolt retraction arm on said second lever hub [190] further comprises a V-shaped notch [197].

6. A mortise lock as recited in claim 2 wherein said bolt retraction arm on said second lever hub [190] further comprises a U-shaped notch [198].

7. A mortise lock as recited in claim 3, 4, 5, or 6 further comprising a lock block pin [161] located in said pin hole [152].

8. A mortise lock as recited in claim 1 wherein said first tab [151] on said lock block [150] further comprises a screw hole [153].

9. A mortise lock as recited in claim 8 wherein said bolt retraction arm on said first lever hub [180] further comprises: a V-shaped notch [187].

10. A mortise lock as recited in claim 8 wherein said bolt retraction arm on said first lever hub [180] further comprises: a U-shaped notch [188].

11. A mortise lock as recited in claim 8 wherein said bolt retraction arm on said second lever hub [190] further comprises: a V-shaped notch [197].

12. A mortise lock as recited in claim 8 wherein said bolt retraction arm on said second lever hub [190] further comprises: a U-shaped notch [198].

13. A mortise lock as recited in claim 9, 10, 11, or 12 further comprising a lock block screw [162] located in said screw hole [153].

14. A mortise lock as recited in claim 1 wherein said second tab [154] on said lock block [150] further comprises a pin hole [155].

15. A mortise lock as recited in claim 14 wherein said bolt retraction arm [184] on said first lever hub [180] further comprises a V-shaped notch [187].

16. A mortise lock as recited in claim 14 wherein said bolt retraction arm [184] on said first lever hub [180] further comprises a U-shaped notch [188].

17. A mortise lock as recited in claim 14 wherein said bolt retraction arm [194] on said second lever hub [190] further comprises a V-shaped notch [197].

18. A mortise lock as recited in claim 14 wherein said bolt retraction arm [194] on said second lever hub [190] further comprises a U-shaped notch [198].

19. A mortise lock as recited in claim 15, 16, 17, or 18 further comprising a lock block pin [161] located in said pin hole [155].

20. A mortise lock as recited in claim 1 wherein said second tab [154] on said lock block [150] further comprises: a screw hole [156].

21. A mortise lock as recited in claim 20 wherein said bolt retraction arm [184] on said first lever hub [180] further comprises a V-shaped notch [187].

22. A mortise lock as recited in claim 20 wherein said bolt retraction arm [184] on said first lever hub [180] further comprises a U-shaped notch [188].

23. A mortise lock as recited in claim 20 wherein said bolt retraction arm [194] on said second lever hub [190] further comprises a V-shaped notch [197].

24. A mortise lock as recited in claim 20 wherein said bolt retraction arm [194] on said second lever hub [190] further comprises a U-shaped notch [198].

25. A mortise lock as recited in claim 21, 22, 23, or 24 further comprising a lock block screw [162] located in said screw hole [153].

* * * * *